US007097384B2

(12) United States Patent
Lindley

(10) Patent No.: US 7,097,384 B2
(45) Date of Patent: Aug. 29, 2006

(54) UNIVERSAL POWER UNIT THAT ADAPTS TO ALL PHASES FROM PLACING TO FINAL FINISHING OF CONCRETE

(76) Inventor: Joseph W. Lindley, 201 Matthew Dr., Paducah, KY (US) 42001

( * ) Notice: Subject to any disclaimer, the term of this patent is extended or adjusted under 35 U.S.C. 154(b) by 92 days.

(21) Appl. No.: 10/513,920

(22) PCT Filed: May 14, 2003

(86) PCT No.: PCT/US03/15139

§ 371 (c)(1),
(2), (4) Date: Nov. 9, 2004

(87) PCT Pub. No.: WO03/097939

PCT Pub. Date: Nov. 27, 2003

(65) Prior Publication Data

US 2005/0163566 A1 Jul. 28, 2005

Related U.S. Application Data

(60) Provisional application No. 60/412,996, filed on Sep. 23, 2002, provisional application No. 60/385,732, filed on Jun. 4, 2002, provisional application No. 60/383,512, filed on May 28, 2002, provisional application No. 60/380,536, filed on May 14, 2002.

(51) Int. Cl.
*E01C 19/22* (2006.01)
*E01C 19/30* (2006.01)

(52) U.S. Cl. ..... 404/118; 404/114

(58) Field of Classification Search ..... 404/114, 404/118

See application file for complete search history.

(56) References Cited

U.S. PATENT DOCUMENTS

| | | | | |
|---|---|---|---|---|
| 2,314,985 | A | 3/1943 | Jackson | |
| 2,651,980 | A | 9/1953 | Wells et al. | |
| 3,180,625 | A * | 4/1965 | Wyzenbeek | 366/122 |
| 3,782,693 | A * | 1/1974 | Strohback | 366/122 |
| 4,073,593 | A * | 2/1978 | Storm | 404/114 |
| 5,244,305 | A | 9/1993 | Lindley | |
| D343,998 | S | 2/1994 | Griggs | |
| 5,857,803 | A | 1/1999 | Davis et al. | |
| 5,984,571 | A | 11/1999 | Owens | |
| 6,065,859 | A * | 5/2000 | Breeding | 366/121 |
| 6,132,134 | A | 10/2000 | Hodgson | |
| 6,139,217 | A | 10/2000 | Reuter | |
| 6,200,065 | B1 * | 3/2001 | Eitzen | 404/114 |
| 6,231,331 | B1 | 5/2001 | Lievers | |
| 6,374,569 | B1 | 4/2002 | Suckow | |
| 6,543,926 | B1 * | 4/2003 | Sherez | 366/108 |

* cited by examiner

*Primary Examiner*—Raymond Addie
(74) *Attorney, Agent, or Firm*—Barnes & Thornburg LLP

(57) ABSTRACT

A vibratory power unit (10, 210) having small gasoline engine (12) coupled by a drive shaft (15) extending through a semi-rigid shaft case (16, 18, 20) to an eccentric (75) rotating with the aid of sealed bearings (74, 78) within a vibrator case (14, 514) is disclosed. The semi-rigid shaft case includes a first rigid shaft case portion (16) and a second rigid shaft case portion (20) coupled together by an isolator (18, 518, 618). A coupling (90, 790) is provided for removably coupling the vibratory power unit (10, 210) to concrete finishing tools (11, 211). The coupling includes a split ball (92) configured to be received on the vibrator case (14, 514) and a slit ring (110) configured to compress the split ball (92) onto the vibrator case (14, 514). A radio controlled throttle controller (300, 400, 500) is provided for remotely controlling the speed of engine (12). Radio controlled throttle controller (300, 400) scavenges electrical power from the magneto circuitry of the engine (12).

18 Claims, 29 Drawing Sheets

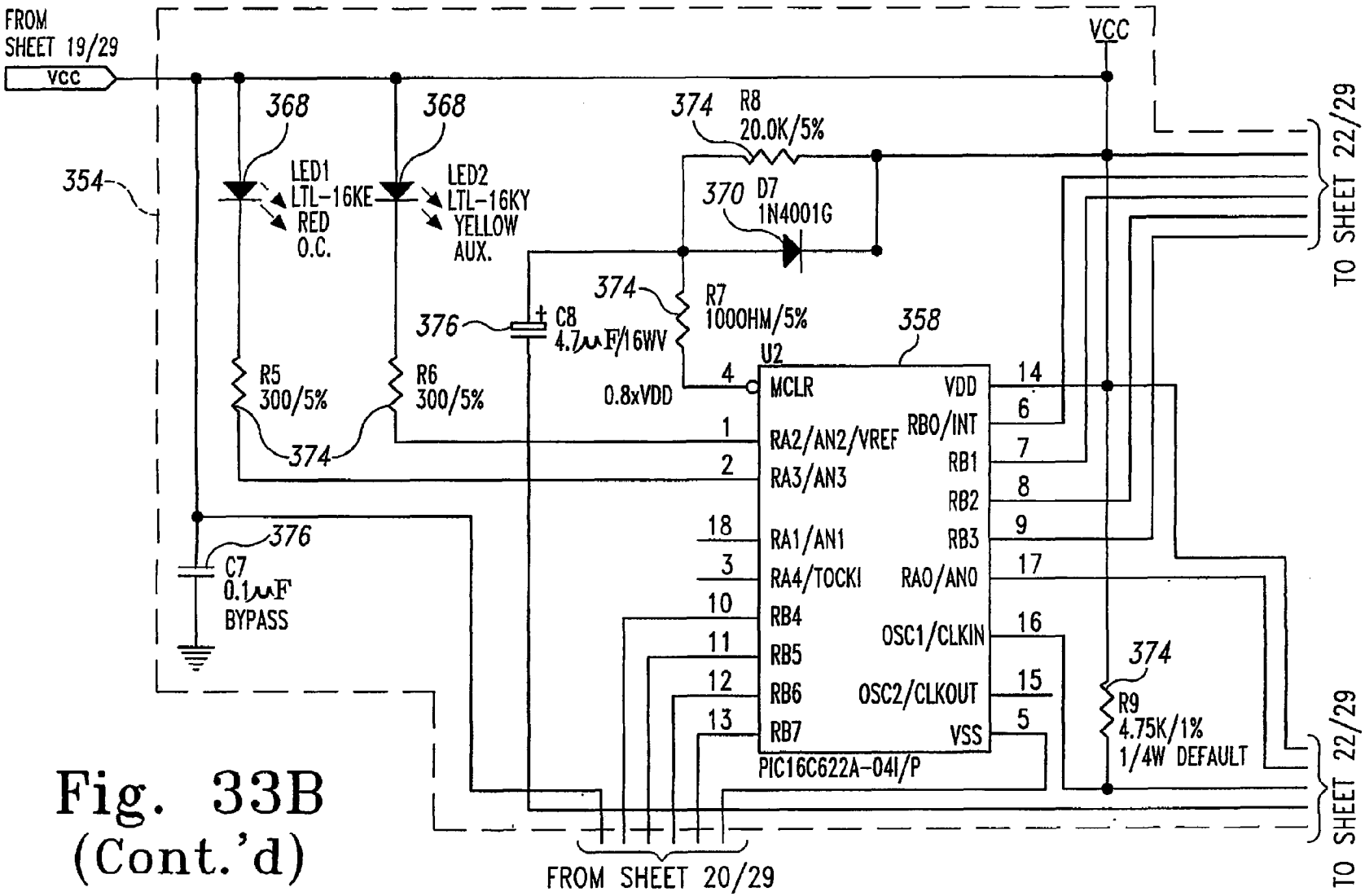
Fig. 33B (Cont.'d)

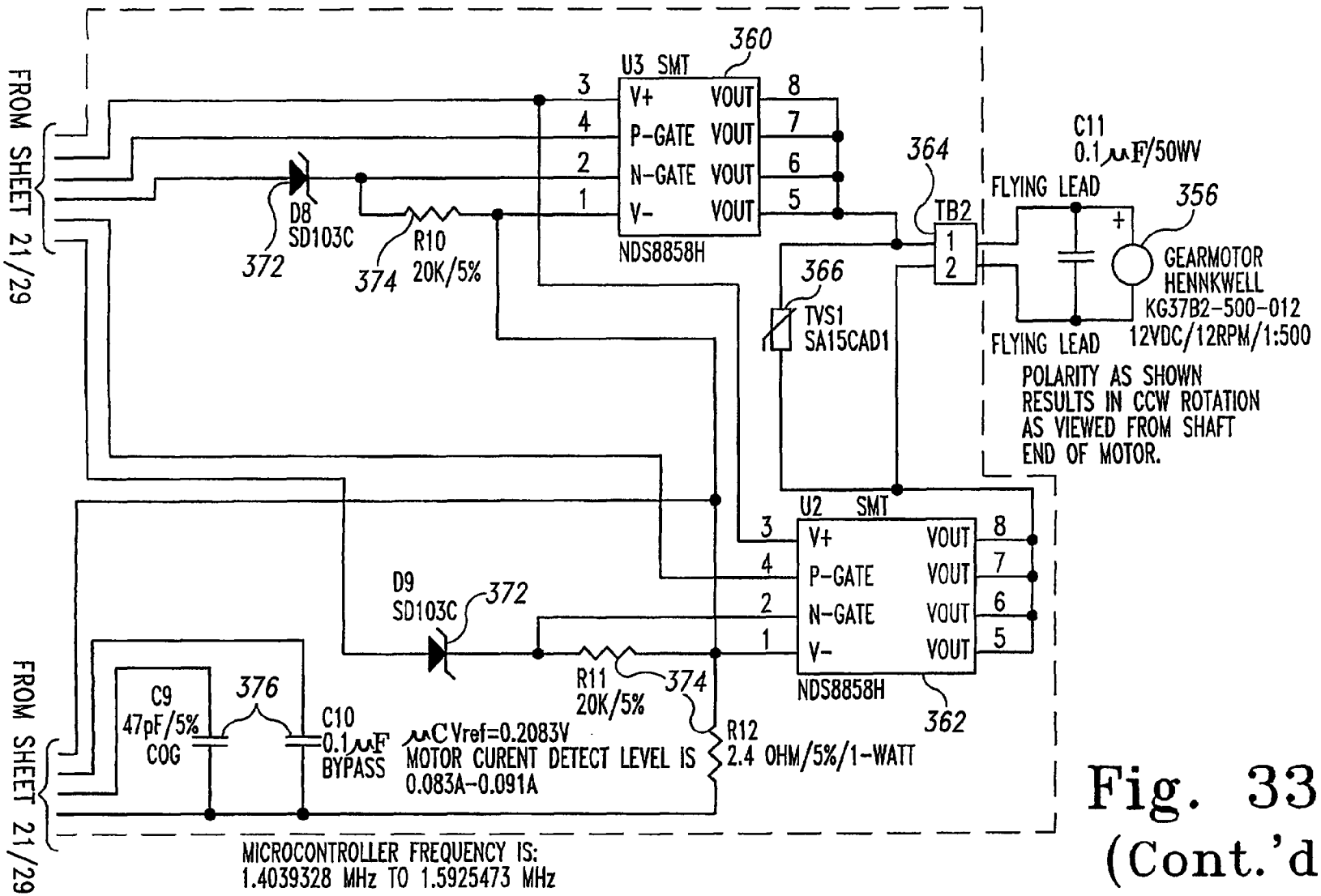
Fig. 33B (Cont.'d)

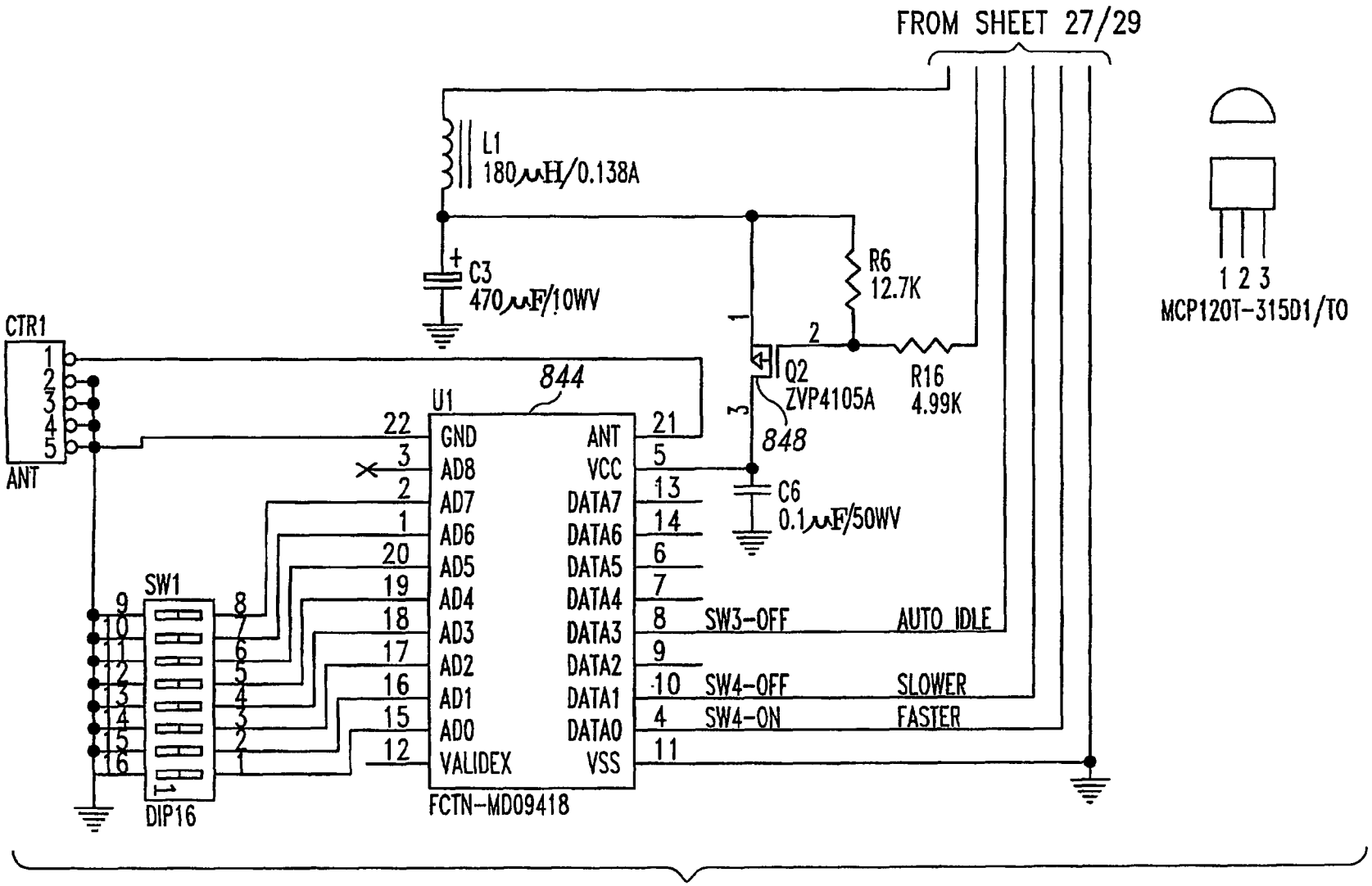
Fig. 41 (Cont.'d)

UNIVERSAL POWER UNIT THAT ADAPTS TO ALL PHASES FROM PLACING TO FINAL FINISHING OF CONCRETE

CROSS REFERENCE TO RELATED APPLICATIONS

This application is a U.S. national counterpart application of international application Ser. No. PCT/US2003/015139 filed May 14, 2003, which claims priority to U.S. Provisional Application No. 60/380,536 filed May 14, 2002, U.S. Provisional Application No. 60/383,512 filed May 28, 2002, U.S. Provisional Application No. 60/385,732 filed Jun. 4, 2002, and U.S. Provisional Application No. 60/412,996 filed Sep. 26, 2002. The entireties of these applications are hereby incorporated by reference.

BACKGROUND AND SUMMARY

This invention relates generally to vibrating concrete for compaction, vibrating screed bars for screeding, vibrating tools used for smoothing the concrete, tooling construction joints and edges and more particularly to gasoline engine powered vibrator for vibrating tools for finishing concrete.

Once concrete is placed, it is typically necessary to level the surface of the concrete, compact concrete, create construction joints, apply an edge finish to the concrete and finish the centers. The advantages of vibrating tools in finishing concrete are well known. Gasoline and electric powered vibrating screeds are commonly used for screeding and consolidating the concrete. Such screeds include a gasoline powered internal combustion engine or an electric powered motor coupled to an unbalanced shaft or eccentric which vibrates a metal bar which is used to strike off (remove excess) and smooth freshly poured concrete. Recently small internal combustion engines (between one and two horsepower) have begun to replace electric motors to power concrete vibrators that consolidate freshly placed concrete in walls, form structures, foundation slabs and the like. These small internal combustion engines are self contained and more portable than electric motors previously used to power concrete vibrators.

In recent years the small hand held gas powered engines have become popular for vibrating concrete to remove the air pockets created when placing the concrete. It is believed that sealed bearings may have been used for the vibrators while screeding concrete but these vibrators were not designed to be submerged in to the cement. When the designs were altered to submerge the gas-powered vibrators in cement the designers changed to oil bath lubrication from the sealed bearings because industry practice for submersible consolidation vibrators has been to provide oil bath lubrication for bearings in a submersible vibrator. Typically, submersible consolidation vibrators were powered by an electric motor. Electric powered vibrators that have been used for many years turn approximately 10,000 to 12,000 RPM. Oil bath lubricated bearings were used in electrically powered consolidation vibrators because of the high operating RPMs.

Vibrators used for screeding concrete (and with other concrete finishing tools) only need to turn at approximately 3,000 RPM. Small handheld gasoline engine generate 300 RPM at about one half throttle. When used for consolidating concrete (not screeding) the small engines are run at full throttle, i.e. about 6,000 RPM.

It is believed that when small gas-powered engines drive vibrators using an oil bath for lubrication additional torque is required to turn the eccentric as a result of added friction compared to a vibrator using sealed bearings. This in turn may severally limit the size of the eccentric used for vibration. Testing and research has established that the small gas-powered engines do not turn enough RPM to damage sealed bearings.

A vibratory power unit in accordance with the disclosure herein will contain one or more of the following features and limitation either alone or in combination, an internal combustion engine, a vibrator coupled to the internal combustion engine, a semi-rigid shaft case extending between the internal combustion engine and the vibrator and an isolation unit disposed between the internal combustion engine and the vibrator to reduce vibrations experienced by the internal combustion engine. A coupling configured to releasably couple the vibrator to a concrete finishing tool and to transfer vibration from the vibrator to the finishing tool may be provided. A handle may be coupled to the semi-rigid shaft whereby the user can control rotation of a concrete finishing tool coupled to the vibrator. The coupling may be configured to permit adjustment of the vertical angle between the finishing face of the concrete finishing tool and the longitudinal axis of the semi-rigid shaft case. The coupling may also be configured to permit adjustment of the horizontal angle between the concrete finishing tool and the longitudinal axis of the semi-rigid shaft case. The semi-rigid shaft case may include a first rigid shaft case portion and a second rigid shaft case portion with the isolation unit coupling the first rigid shaft case portion to the second rigid shaft case portion. Preferably, the vibrator utilizes sealed bearings. A plurality of vibrators of varying lengths and diameters may be provided for attachment to the semi-rigid shaft.

According to a second embodiment of the disclosure, a vibrating concrete tool includes one or more of the following limitations, alone or in combination, an internal combustion engine, a vibrator coupled to the internal combustion engine, a concrete finishing tool, a mount for mounting the internal combustion engine to the concrete finishing tool, an elongated handle for manipulating the concrete finishing tool and internal combustion engine as a unit and an attachment for coupling the handle to the finishing tool, said attachment permitting selective alteration of the vertical angle between the concrete finishing tool and the longitudinal axis of the handle. The mount is configured to couple the vibrator to the concrete finishing tool and to transfer vibrations from the vibrator to the concrete finishing tool. The mount is preferably configured to permit coupling of the attachment and the vibrator at substantially the same position between the ends of the concrete finishing tool. The mount may be configured to provide structural support to the concrete finishing tool. A remotely actuatable throttle control may be coupled to the engine. The remotely actuatable throttle control may be configured to control actuators powered, at least in part, by power scavenged from the engine magneto circuitry.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE FIGURES

The detailed description particularly refers to the accompanying drawings in which:

FIG. 4 shows a finishing trowel with a jointing attachment coupled to the vibratory power unit;

DETAILED DESCRIPTION OF THE ILLUSTRATED EMBODIMENTS

Figure 3:
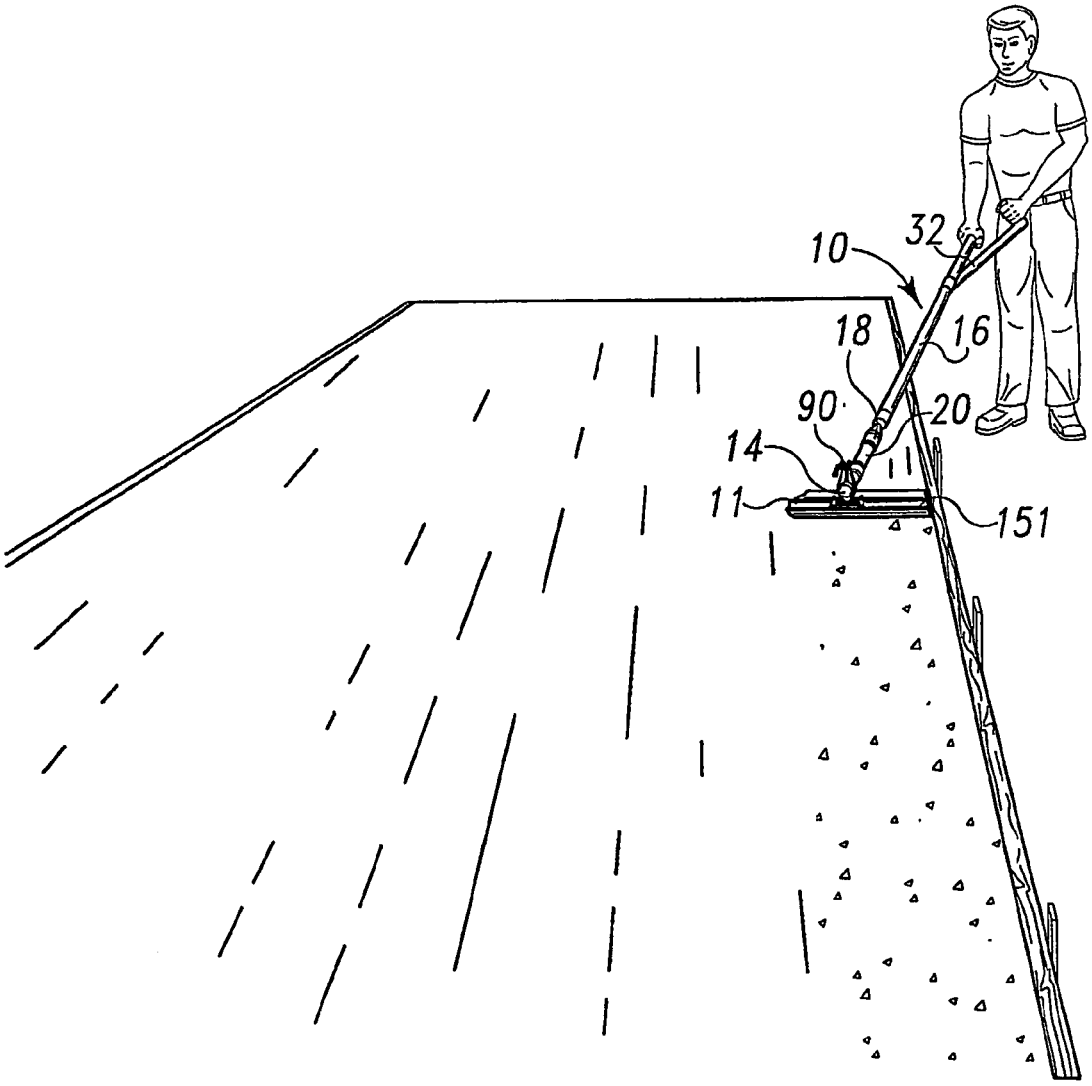
FIG. 3 is a perspective view of the vibratory power unit of FIG. 1 with a concrete finishing tool of FIG. 2 attached to the vibrator case by the coupling illustrating how the lever lift handle is used to control rotation of the attached finishing tool.
Figure 4:
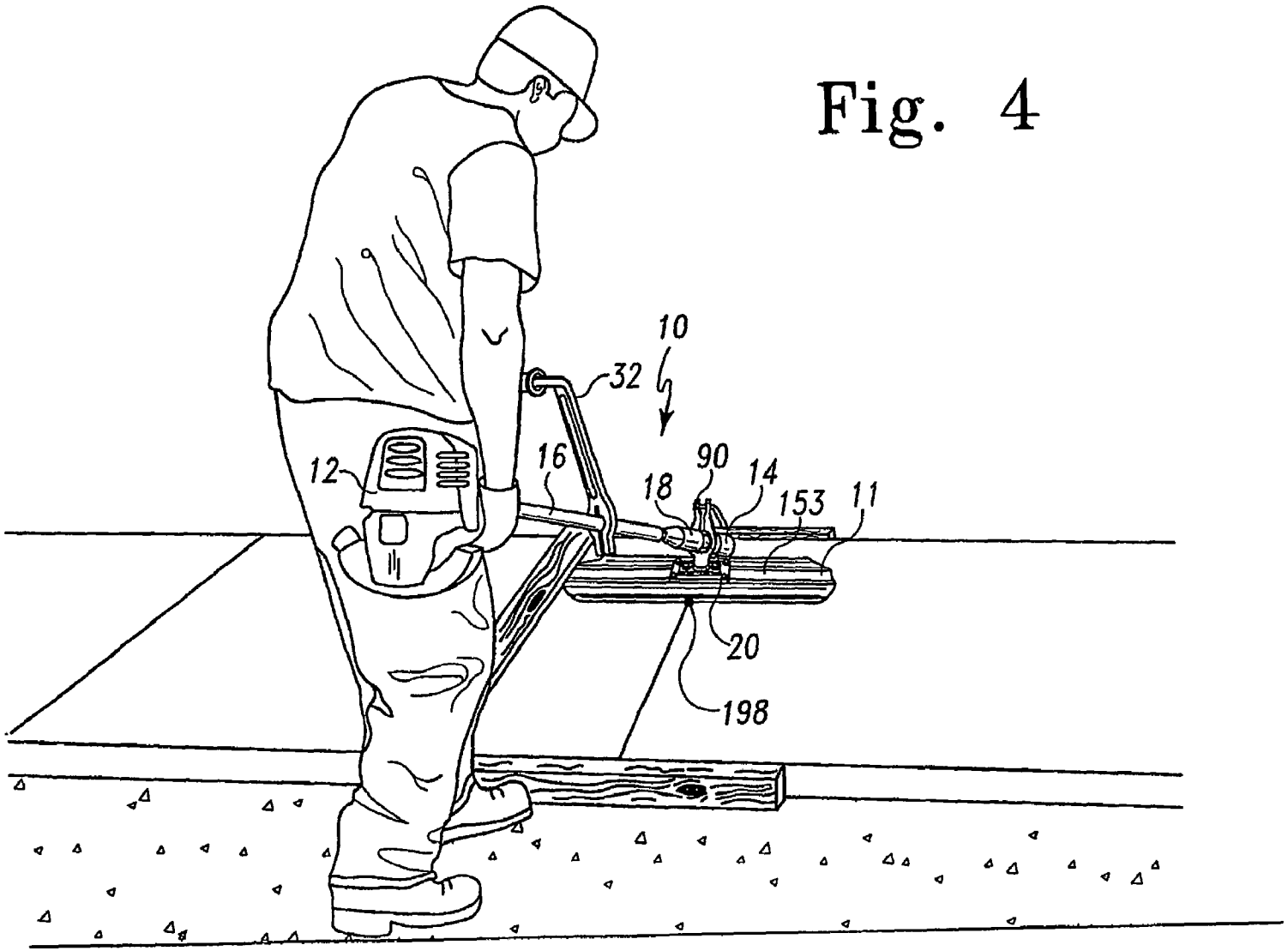
FIG. 4 is a perspective view of the vibratory power unit of FIG. 1 with a concrete finishing tool attached to the vibrator by a coupling illustrating how the lever lift handle is used to control rotation of the attached finishing tool.
Figure 5:
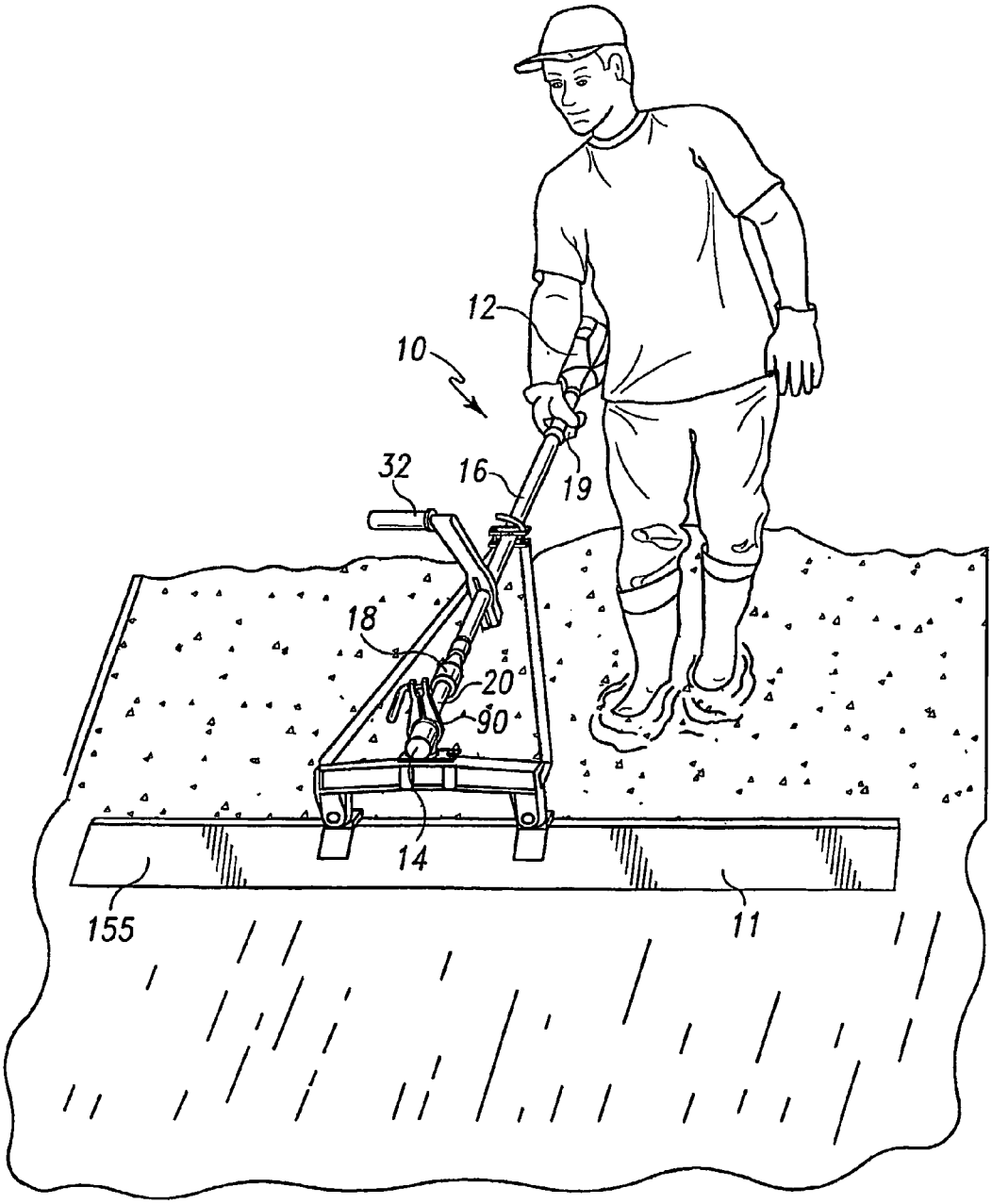
FIG. 5 is a perspective view of the vibratory power unit of FIG. 1 with a screed bar attached to the vibrator by a coupling and a mount.
Figure 6:
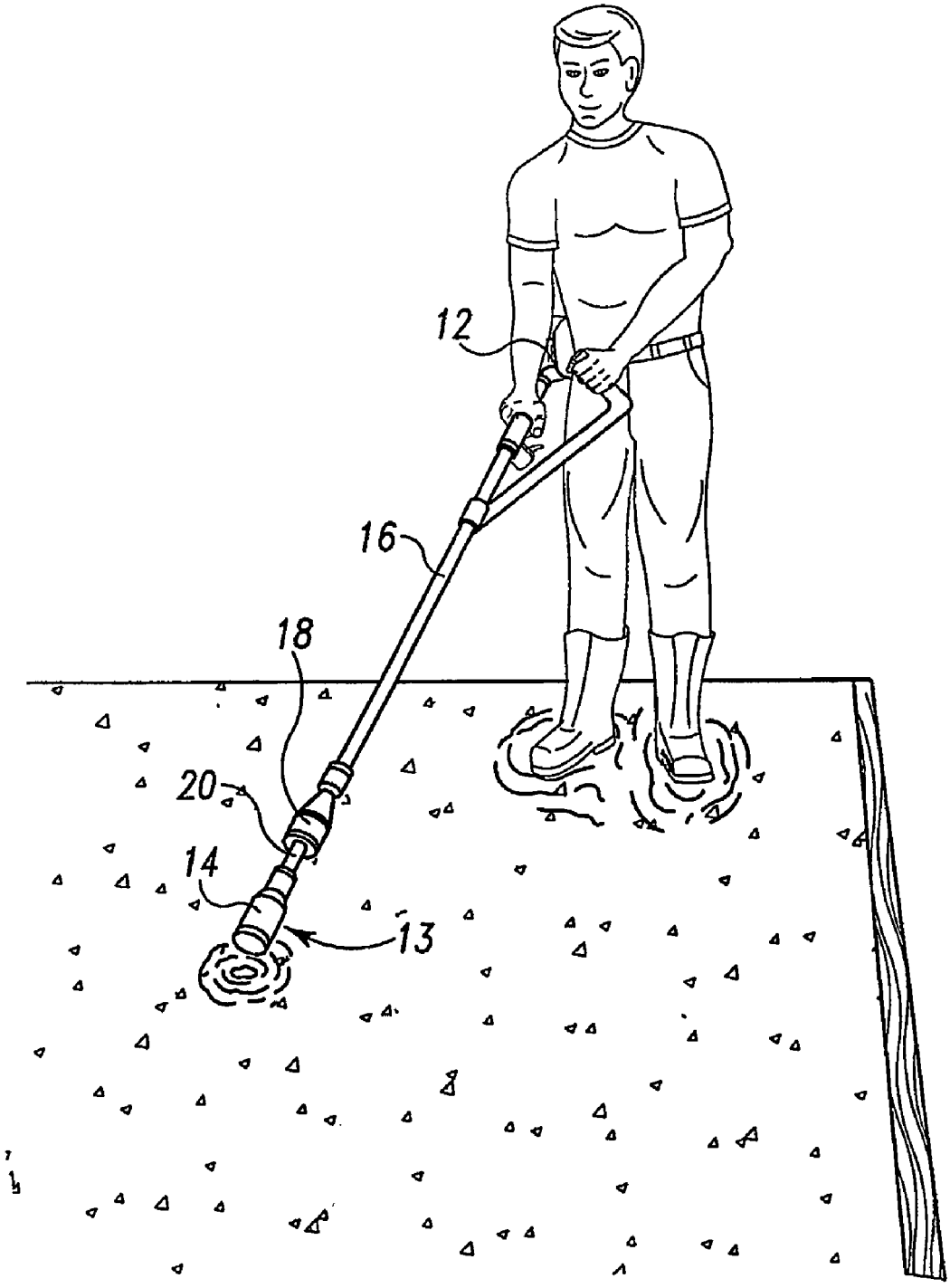
FIG. 6 is a perspective view of the vibratory power unit of FIG. 1 being used as a vibrator to consolidate concrete illustrating how the lever lift handle is used to control the vibratory power unit.

A vibratory power unit 10 is provided which may be used in its clean configuration as a concrete vibrator, as shown for example in FIG. 6, or may be coupled through an adapter to various concrete finishing tools 11, as shown for example, in FIGS. 3–5. The illustrated vibratory power unit 10 includes an internal combustion engine 12 coupled to a flexible drive shaft or cable 15 coupled to a vibrator 13 housed in a vibrator case 14. Flexible drive shaft 15 extends from the engine shaft through a first rigid shaft case portion 16, an isolation unit 18 and a second rigid shaft case portion 20 to vibrator 13 located within vibrator case 14. While a flexible drive shaft 15 is described, it is within the teaching of this disclosure for drive shaft to be rigid.

Illustratively, internal combustion engine 12 is a Robin, 30.5 cc, 2 cycle, 1.5 Horsepower gasoline powered engine having a fingertip throttle control 19. Those skilled in the art will recognize that other small engines may be used within the scope of the disclosure including a Honda/GX31, 31 cc, 4 stroke, 1.5 Horsepower gasoline powered engine or the like. Preferably, engine 12 is selected to permit hand held operation of vibratory power unit 10 in clean configuration or when attached to a concrete finishing tool 11.

In the illustrated embodiment, first and second rigid shaft case portions 16 and 20 are rigid, metallic, hollow, cylindrical tubes having an inside diameter 22 sufficient to receive flexible drive shaft 15 and an outside diameter 24. Illustratively, first and second rigid shaft case portions 16 and 20 are steel tubes. It is within the teaching of the disclosure for first and second rigid shaft case portions 16 and 20 to be made from other material, such as metals, plastics or composites, having sufficient strength to maintain their rigidity under operating conditions.

First rigid shaft case portion 16 is attached at proximal end 26 to engine housing 28 and at distal end 30 to isolation unit 18. Illustratively, a lever control lift handle 32 is removably coupled to first rigid shaft case portion 16 to facilitate manipulation of vibratory power unit 10 by a user. Other handles, similar to those present in string trimmers may be attached to first rigid shaft case portion 16 to facilitate manipulation of vibratory power unit 10 within the teaching of the disclosure. It is within the teaching of the disclosure for lever control lift handle 32 to be removably or permanently attached to vibratory power unit 10 in other locations or for vibratory power unit 10 to not be provided with a lever control lift handle 32.

Isolation units 18, 518 and 618 are configured to reduce the vibrations experienced by a user directly grasping, or grasping a handle coupled to, first rigid shaft case portion 16 and/or engine 12. Isolation units 18, 518, 618 also reduce vibrations experienced by engine 12. Isolation units 18, 518, 618 maintain a substantially rigid coupling between vibrator case 14 and first rigid shaft case portion 16 permitting a user to grasp first rigid shaft case portion 16 and/or engine 12, or a handle coupled to first rigid shaft case portion 16 or engine 12, to control the location of vibrator case 14 as well as any concrete finishing tool 11 which might be coupled to vibrator case 14.

Figure 18:
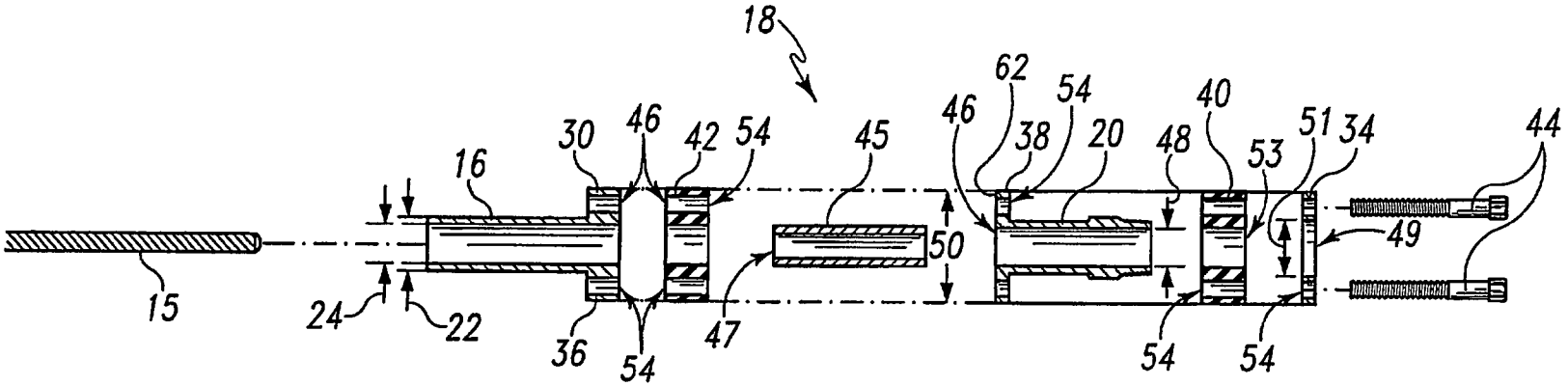
FIG. 18 is an exploded view of the isolation unit of FIG. 1 and the end of a flexible drive shaft.
Figure 19:
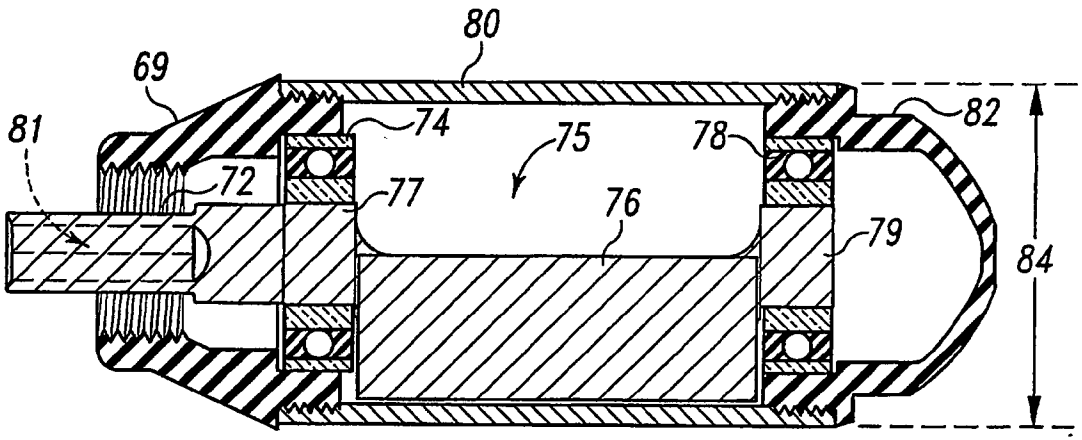
FIG. 19 is a sectional view of the vibrator of FIG. 1.
Figure 20:
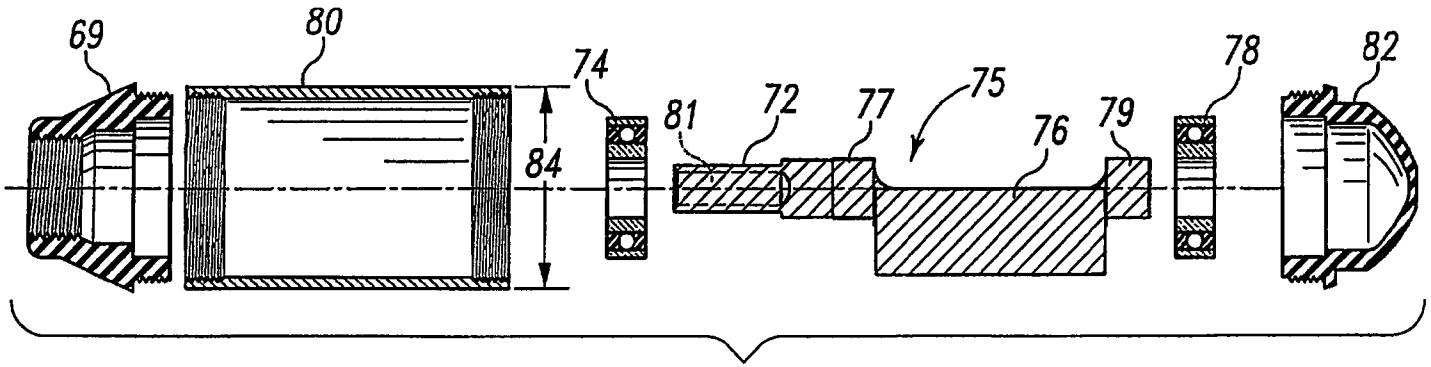
FIG. 20 is a sectional exploded view of the vibrator of FIG. 19.
Figure 21:
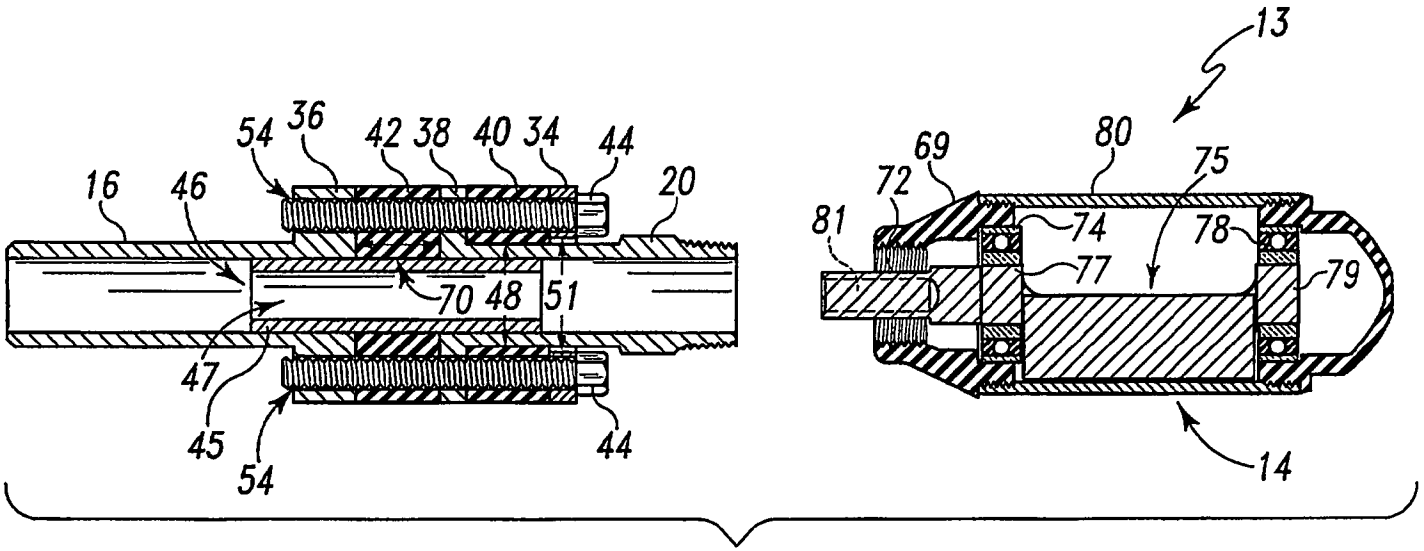
FIG. 21 is a sectional exploded view of the vibrator of FIG. 19 and the isolation unit of FIG. 18.
Figure 22:
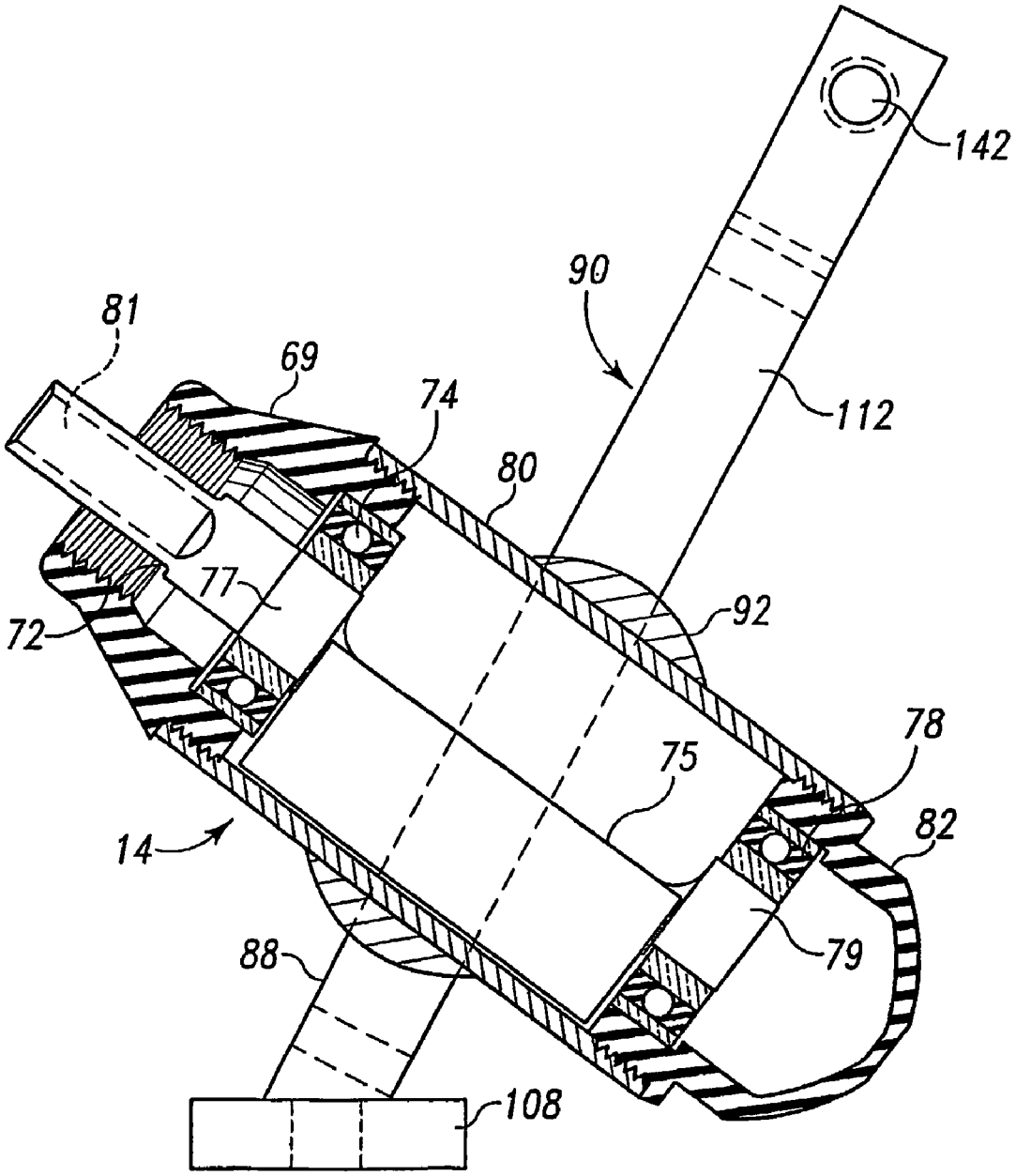
FIG. 22 is a sectional view of the vibrator of FIG. 1 received in the split mounting ring assembly of the coupling of FIGS. 3–5.
Figure 23:
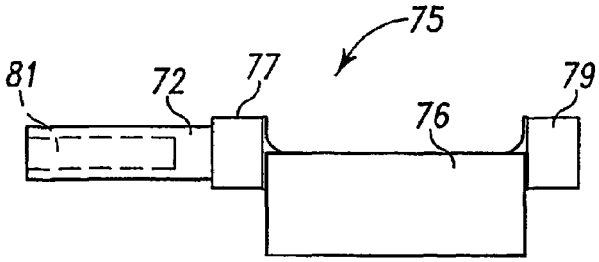
FIG. 23 is a side elevation view of an eccentric.
Figure 24:
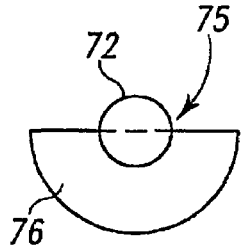
FIG. 24 is an end view of the eccentric of FIG. 23.
Figure 25:
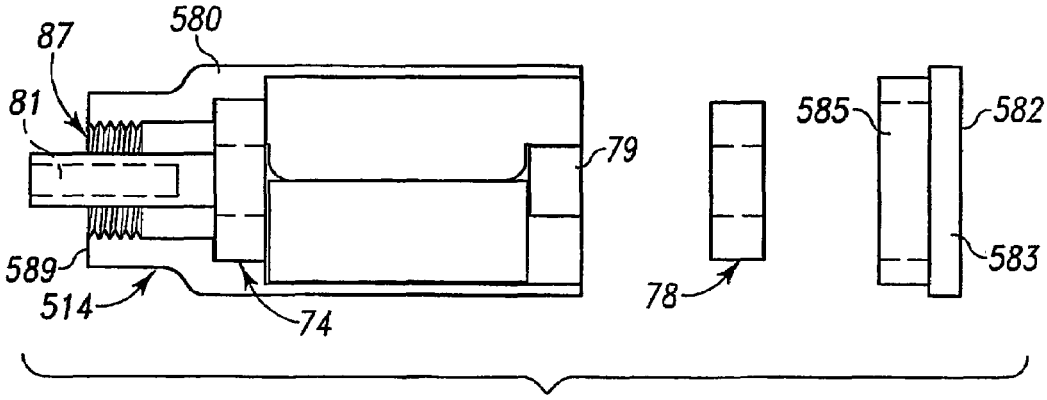
FIG. 25 is a partial exploded view with parts broken away of a vibrator and an alternative vibrator case.
Figure 26:
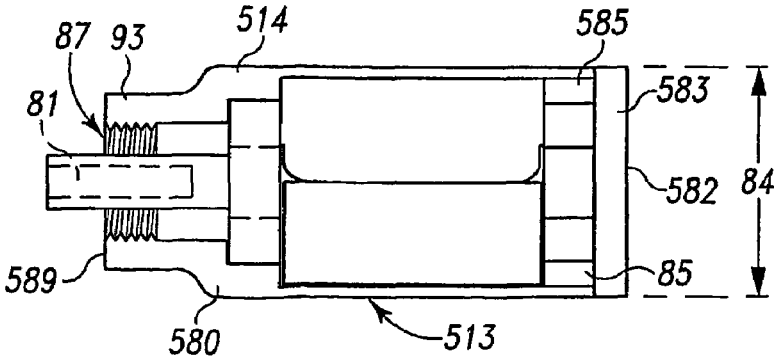
FIG. 26 is a view with parts broken away of the assembled vibrator and vibrator case of FIG. 25.

As shown for example in FIGS. 18 and 21, a first embodiment of isolation unit 18 includes a distal plate 34, a proximal flange 36 extending radially from distal end 30 of first rigid shaft case portion 16, a central flange 38 extending radially from proximal end 62 of second rigid shaft case portion 20, a distal rubber portion 40, a proximal rubber portion 42 and a plurality of fasteners 44 coupling distal plate 34 to proximal flange 36. Distal rubber portion 40 is disposed between distal plate 34 and central flange 38. Illustratively, distal rubber portion 40 is glued to both distal plate 34 and central flange 38. However, it is within the teaching of the disclosure for distal rubber portion 40 to be otherwise affixed to one or both of distal plate 34 and central flange 38 using bonding techniques or adhesives or merely engage one or both of distal plate 34 or central flange 38. Proximal rubber portion 42 is disposed between proximal flange 36 and central flange 38. Illustratively, proximal rubber portion 42 is glued to both proximal flange 36 and central flange 38. However, it is within the teaching of the disclosure for proximal rubber portion 42 to be otherwise affixed to one or both of proximal flange 36 and central flange 38 using bonding techniques or adhesives or merely engage one or both of proximal flange 36 or central flange 38. It has been found that bonding, affixing or gluing rubber portions 40 and 42 to plates and flanges 34, 36, 38 reduces the possibility of soil or concrete entering isolation unit 18, second rigid shaft case portion 20 and vibrator case 14. This also seals against cement and water penetration when vibratory power unit 10 is used for concrete vibration, during use with attached finishing tools 11 or during cleaning of the unit 10.

Proximal flange 36, central flange 38 and proximal rubber portion 42 are each formed to include an aperture 46 extending longitudinally therethrough. Aperture is sized to receive flexible hose 45 having a lumen 47 sized to permit flexible drive shaft 15 to pass therethrough. Flexible hose 45 engages and may be adhered to proximal flange 36, central flange 38 and proximal rubber portion 42 to seal isolation unit 18 against cement and fluid leakage.

Distal plate 34 includes a longitudinally extending aperture 49 having an inside diameter 51 slightly greater than the outside diameter 24 of second rigid shaft case portion 20. The longitudinally extending aperture 53 in distal rubber portion 40 has an inside diameter 48 approximately equal to the outside diameter 24 of second rigid shaft case portion 20. Proximal flange 36, central flange 38, distal plate 34, proximal rubber portion 42 and distal rubber portion 40 each have an outside diameter 50 approximately equal to or less than the outside diameter 84 of vibrator case 14.

Proximal flange 36, central flange 38, distal plate 34, proximal rubber portion 42 and distal rubber portion 40 are each formed to include a plurality of fastener-receiving holes 54. In the illustrated embodiment, four fastener receiving-holes 54, each displaced ninety degrees from its adjacent fastener-receiving holes 54, are formed in each of proximal flange 36, central flange 38, distal plate 34, proximal rubber portion 42 and distal rubber portion 40. When assembled, the fastener-receiving holes 54 in proximal flange 36, central flange 38, distal plate 34, proximal rubber portion 42 and distal rubber portion 40 are aligned to facilitate passage of the shafts of fasteners 44 through proximal flange 36, central flange 38, distal plate 34, proximal rubber portion 42 and distal rubber portion 40. In the illustrated first embodiment of isolation unit 18, four fasteners 44 secure the components of isolation unit 18 together. Each illustrated fastener 44 is bolt with a threaded shaft. The fastener-receiving hole 54 in proximal flange 36 is internally threaded to receive the threaded shaft of fastener 44. The head of each fastener 44 engages the distal plate 34 and the nut of each fastener engages the distal plate 36. Illustratively, lock-tite or other thread adhesive is to secure threaded shaft of bolt to internal threads of fastener-receiving hole 54 in proximal flange 36. It is within the teaching of the disclosure to use other fasteners or fastening methods to secure the components of isolation unit 18 together in a substantially rigid fashion.

In the first illustrated embodiment of isolation unit 18, proximal end 62 of second rigid shaft case portion 20 extends through the central aperture 49 in distal plate 34 and the central aperture 53 in distal rubber portion 40. In the illustrated embodiment, second rigid shaft case portion 20 is integrally formed to include central flange 38. In isolation unit 18, the distal end 30 of first rigid shaft case portion 16 is formed to include proximal flange 36. It is within the teaching of the disclosure for proximal and central flanges 36 and 42 to be plates welded or otherwise affixed to distal end 30 of first rigid shaft case portion 16 and proximal end 62 of second rigid shaft case portion 20, respectively.

In the illustrated first embodiment of isolation unit 18, second rigid shaft case portion 20 floats within the central aperture 49 of distal plate 34 and the shafts of fasteners 44 float within the fastener-receiving apertures 54 of proximal rubber portion 42, central flange 38, distal rubber portion 40 and distal plate 34. Additionally a gap 70 is formed between distal end 30 of first rigid shaft case portion 16 and proximal end 62 of second rigid shaft case portion 20 which is filled with proximal rubber potion 42. Isolation unit 18 acts to couple first and second rigid shaft case portions 16 and 20 together while reducing the transfer of vibrations from second rigid shaft case portion 20 to first rigid shaft case portion 16. Fasteners 44, and to a lesser extent proximal rubber portion 42 and flexible hose 45, provide a lateral rigidity to isolation unit 18 and bear much of the longitudinal load to which isolation unit 18 is subjected. Isolation unit 18 permits a user contacting first rigid shaft case portion 16 and/or engine 12 to controllably manipulate vibrator case 14 to properly position vibrator 13 and/or any concrete finishing tool 11 coupled to vibrator case 14.

In the illustrated embodiment of vibratory power unit 10, first rigid shaft case portion 16 is much longer than second rigid shaft case portion 20 so that isolation unit is disposed closer to vibrator 13 than engine 12. This disposition of isolation unit 18 reduces the moment arm of the vibrator so that lateral deflection of the vibrator is minimized. Additionally, it is believed that the lengths of the shaft case portions 16 and 20 can be adjusted, dependant on the operating angular velocity of the eccentric, so that the isolation unit 18 is located at a vibratory node on the shaft to further reduce vibration experience by the user.

Figure 8:
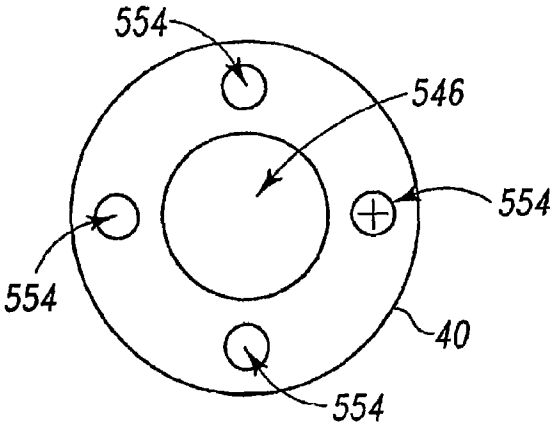
FIG. 8 is a plan view of the proximal rubber portion of FIG. 7.
Figure 9:
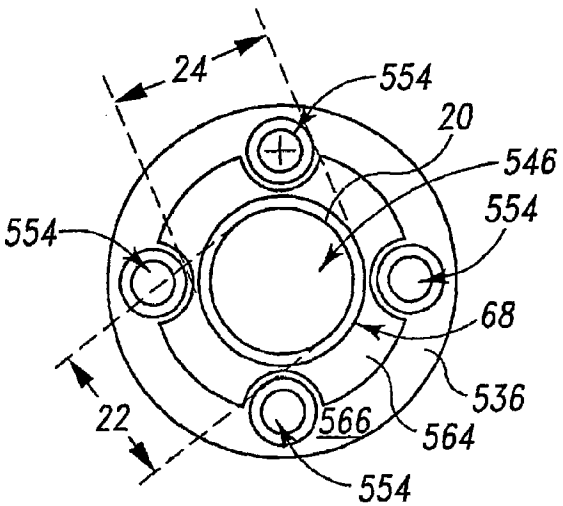
FIG. 9 is a plan view of the isolation unit of FIG. 7.
Figure 7:
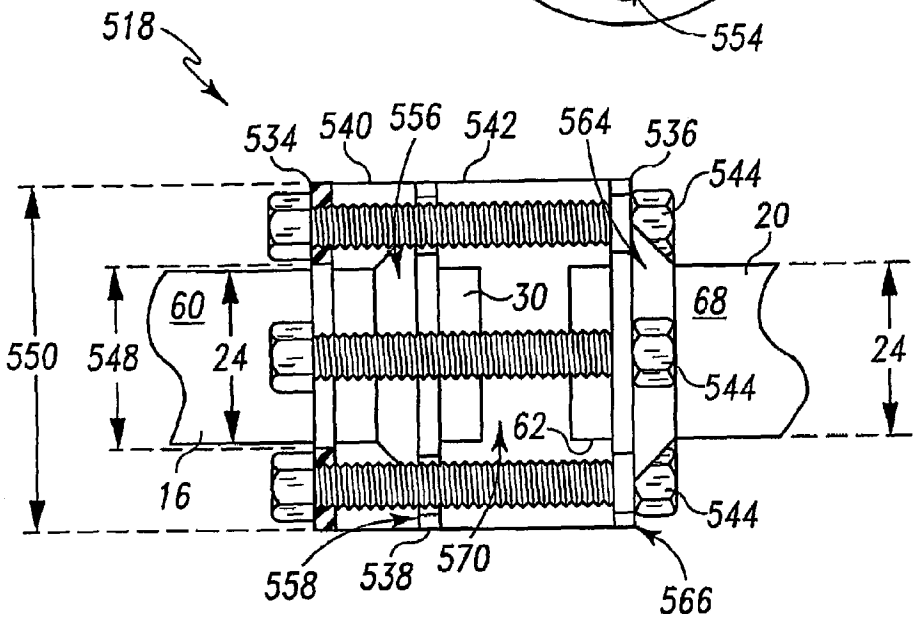
FIG. 7 is a side view with parts broken away of an alternative isolation unit showing a proximal plate, central plate, distal plate, proximal rubber portion, distal rubber portion and fasteners securing the plates and portions together in a substantially rigid manner.
Figure 14:
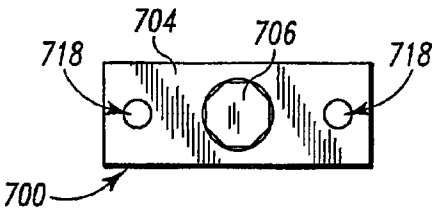
FIG. 14 is a plan view of a tool mount bar of the coupling unit of the coupling of FIG. 10.
Figure 15:
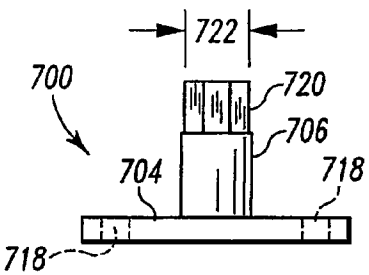
FIG. 15 is a front elevation view of the tool mount bar of FIG. 14 showing a stud having an octagonal portion extending upwardly from a plate configured to be mounted to a concrete finishing tool.

A second embodiment of isolation unit 518 is shown in FIGS. 7–9. Illustratively, isolation unit 518 includes a proximal plate 534, a distal plate 536, a central plate 538, a proximal rubber portion 540, a distal rubber portion 542 and a plurality of fasteners 544 coupling proximal plate 534 to distal plate 536. Proximal rubber portion 540 is disposed between proximal plate 534 and central plate 538. Illustratively, proximal rubber portion 540 is glued to both proximal plate 534 and central plate 538. However, it is within the teaching of the disclosure for proximal rubber portion 540 to be otherwise affixed to one or both of proximal plate 534 and central plate 538 using bonding techniques or adhesives or merely engage one or both of proximal plate 534 or central plate 538. Distal rubber portion 542 is disposed between distal plate 536 and central plate 538. Illustratively, distal rubber portion 542 is glued to both distal plate 536 and central plate 538. However, it is within the teaching of the disclosure for distal rubber portion 542 to be otherwise affixed to one or both of distal plate 536 and central plate 538 using bonding techniques or adhesives or merely engage one or both of distal plate 536 or central plate 538. It has been found that bonding, affixing or gluing rubber portions 540 and 542 to plates 534, 536, 538 reduces the possibility of soil entering isolation unit 518, second rigid shaft case portion 20 and vibrator case 14 when vibratory power unit 10 is used as a piercer. This also seals against cement and water penetration when vibratory power unit 10 is used for concrete vibration, during use with attached finishing tools or during cleaning of the unit 10.

Proximal plate 534, distal plate 536, central plate 538, proximal rubber portion 540 and distal rubber portion 542 are each formed to include an aperture 546 extending longitudinally therethrough sized to permit passage of flexible drive shaft 15 therethrough. The longitudinally extending apertures 546 in proximal plate 534, central plate 538 and proximal rubber portion 540 each have an inside diameter 548 slightly greater than the outside diameter 24 of first rigid shaft case portion 16. The longitudinally extending aperture in distal plate 536 has an inside diameter slightly greater than the outside diameter 24 of second rigid shaft case portion 20. Proximal plate 534, central plate 538, distal plate 536, proximal rubber portion 540 and distal rubber portion 542 each have an outside diameter 550 approximately equal to or less than the outside diameter 84 of vibrator case 14.

Proximal plate 534, central plate 538, distal plate 536, proximal rubber portion 540 and distal rubber portion 542 are each formed to include a plurality of fastener-receiving holes 554. In the illustrated embodiment, four fastener receiving-holes 554 each displaced ninety degrees from its adjacent fastener-receiving holes 554 are formed in each of proximal plate 534, central plate 538, distal plate 536, proximal rubber portion 540 and distal rubber portion 542. When assembled, the fastener-receiving holes 554 in proximal plate 534, central plate 538, distal plate 536, proximal rubber portion 540 and distal rubber portion 542 are aligned to facilitate passage of the shafts of fasteners 544 through proximal plate 534, central plate 538, distal plate 536, proximal rubber portion 540 and distal rubber portion 542. In the illustrated embodiment of isolation unit 518, four fasteners 544 secure the components of isolation unit 518 together. Each illustrated fastener 544 is bolt with a threaded shaft and a nut sized to be received on the threaded shaft of the bolt. The head of each fastener engages the proximal plate 534 and the nut of each fastener engages the distal plate 536. Illustratively, lock-tite or other thread adhesive is to secure nut to the threaded shaft of bolt. It is within the teaching of the disclosure to use other fasteners or fastening methods to secure the components of isolation unit 518 together in a substantially rigid fashion.

In the illustrated embodiment, distal end 30 of first rigid shaft case portion 16 extends through the central apertures 546 in proximal plate 534, proximal rubber portion 540 and central plate 538 and partially into central aperture 546 of distal rubber portion 542. In the illustrated embodiment, first rigid shaft case portion 16 is secured to central plate 538 by welding. Illustratively, weld bead 556 extends between the proximal face 558 of the central plate 538 and the outside wall 60 of first rigid shaft case portion 16. In the illustrated embodiment, the proximal end 62 of second rigid shaft case portion 20 extends through the central aperture 546 in distal plate 536 and partially into central aperture 546 of distal rubber portion 542. In the illustrated embodiment, second rigid shaft case portion 20 is secured to distal plate 536 by welding. Illustratively, weld bead 564 extends between the distal face 566 of the distal plate 536 and the outside wall 68 of second rigid shaft case portion 20. Those skilled in the art will recognize that weld beads 556, 564 may be formed on the opposite sides of plates 538, 536 within the scope of the disclosure to secure first rigid shaft case portion 16 to central plate 538 and second rigid shaft case portion 20 to distal plate 536. Also, it is within the scope of the disclosure for first rigid shaft case portion 16 and second rigid shaft case portion 20 to be secured to central and distal plates 538 and 536, respectively in other manners including expansion of the case walls adjacent the plates 538 and 536 and other joining techniques.

In the illustrated embodiment first rigid shaft case portion 16 floats within the central aperture 546 of proximal plate 534 and the shafts of fasteners float within the fastener-receiving apertures 554. Additionally a gap 570 is formed between distal end 30 of first rigid shaft case portion 16 and proximal end 62 of second rigid shaft case portion 20. Isolation unit 518 acts to couple first and second rigid shaft case portions 16 and 20 together while reducing the transfer of vibrations from second rigid shaft case portion 20 to first rigid shaft case portion 16. Fasteners 544 provide a lateral rigidity to isolation unit 518 and bear much of the longitudinal load to which isolation unit 518 is subjected. Isolation unit 518 permits a user contacting first rigid shaft case portion 16 and/or engine 12 to controllably manipulate vibrator case 14 to properly position vibrator 13 and/or any concrete finishing tool 11 coupled to vibrator case 14.

Figure 29:
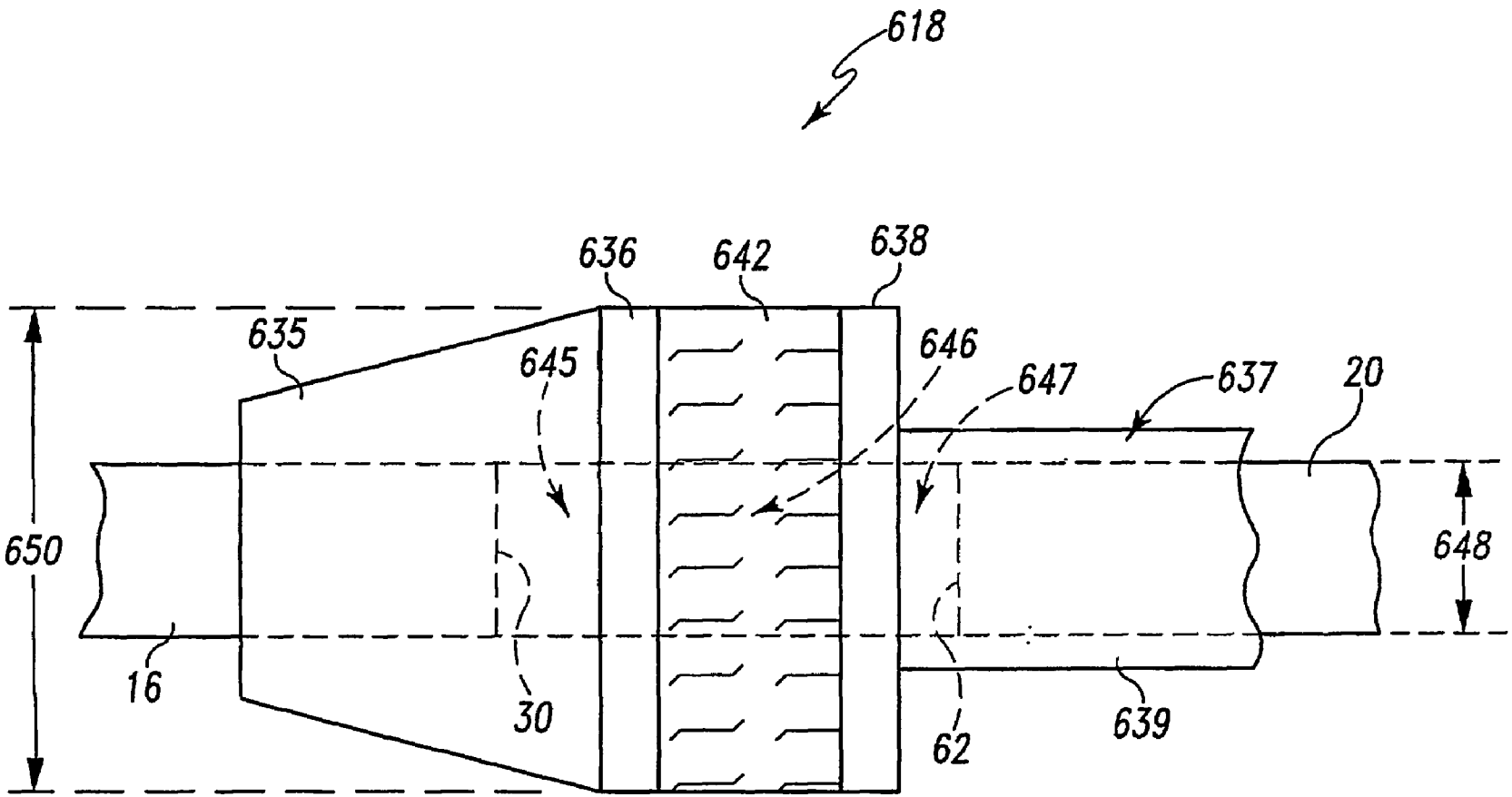
FIG. 29 is a side elevation view of an alternative embodiment of an isolation unit formed by molding a rubber portion between the a proximal flange on a housing coupled to the distal end of the first rigid shaft case portion and a distal flange on a housing coupled to the proximal end of the second rigid shaft case portion.

A third embodiment of isolation unit 618 is shown in FIG. 29. Isolation unit 618 is formed by integrally molding a rubber portion 642 to a proximal flange 636 on a proximal housing 635 and a distal flange 638 on a distal housing 637.

In the illustrated embodiment, proximal housing 635 is frusto-conically shaped and includes a central longitudinally extending aperture 645 sized to receive distal end 30 of first rigid shaft case portion 16 therein. In the illustrated embodiment, proximal housing 635 is molded from aluminum or an aluminum alloy.

Rubber portion 642 is disposed between proximal flange 636 and distal flange 638. Illustratively, rubber portion 642 is cylindrical shaped with a central longitudinal aperture 646 extending longitudinally therethrough. Rubber portion 642 is molded to distal flange 638 and proximal flange 636. However, it is within the teaching of the disclosure for rubber portion 642 to be otherwise affixed to distal flange 638 and proximal flange 636 using bonding techniques. Illustratively, rubber portion 642 is molded from 45 durometer natural rubber. It is within the scope of the disclosure for rubber portion 645 to be made from other appropriate materials.

Illustratively, distal housing includes a cylindrical body 639 and distal flange 638. A central longitudinally extending aperture 647 extends through body 639 and distal flange 638. Central aperture 647 is sized to receive proximal end 62 of second rigid shaft case portion 20 therein. Illustratively, distal housing 37 is cast from 12L 14 steel.

Illustratively, central apertures 645, 646, and 647 each have an inside diameter 648 sized to permit passage of flexible drive shaft 15 therethrough. Proximal flange 636, distal flange 638 and rubber portion 642 each have an outside diameter 650 approximately equal to or less than the outside diameter 84 of vibrator case 14.

Isolation unit 618 acts to couple first and second rigid shaft case portions 16 and 20 together while reducing the transfer of vibrations from second rigid shaft case portion 20 to first rigid shaft case portion 16. Isolation unit 618 permits a user contacting first rigid shaft case portion 16 and/or engine 12 to controllably manipulate vibrator case 14 to properly position vibrator 13 and/or any concrete finishing tool 11 coupled to vibrator case 14.

Alternative embodiments of vibrator 13, 513 are shown, for example, in FIGS. 19–22 and FIGS. 23–26. Each embodiment of vibrator 13, 513 includes a vibrator shaft 72 extending through a first set of sealed bearings 74, an eccentric load 76 and a second set of sealed bearings 78. Those skilled in the art will recognize that flexible drive shaft 15 is coupled through vibrator shaft 72 to eccentric load 76, or an unbalanced shaft, which when rotated at high angular velocities creates vibration. In the illustrated embodiments, vibrator 13 is enclosed within a substantially cylindrical vibrator case 14. Additional alternative embodiments of vibrator case 14 are within the scope of the disclosure. Vibrator case 14, 514 may be of different lengths and diameters within the scope of the disclosure. Those skilled in the art will recognize that the eccentric 75, associated with the different vibrator cases will have appropriately proportioned lengths and diameters. Each vibrator 13, 513 includes an eccentric 75 having a vibrator shaft 72 extending through and longitudinally beyond an eccentric load 76. Vibrator shaft 72 includes a first bearing surface 77 and a second bearing surface 79 located on opposite ends of eccentric load 76. Each bearing surface 77, 79 has an outside diameter approximately equal to the inside diameter of the sealed bearings 74, 78. Vibrator shaft 72 extends through a first set of sealed bearings 74, an eccentric load 76 and a second set of sealed bearings 78. Those skilled in the art will recognize that flexible drive shaft 15 is coupled through vibrator shaft 72 to eccentric load 76, or an unbalanced shaft, which when rotated at high angular velocities creates vibration.

In the first embodiment, vibrator case 14 includes a main housing 80, a proximal end cap 69 and a distal end cap 82. Proximal end cap 69 and distal end cap 82 include external threads sized to be received in internal threads in main housing 80. The second embodiment of vibrator 513 is composed of a main housing 580 (essentially an integrally formed combination of main housing 80 and proximal end cap 69 of the first embodiment) and an end cap 582. Internally end caps 82, 582 are sized to be press fit onto second set of sealed bearings 78. Internally, main housings 80, 580 are formed to have a first inside diameter sized to permit free rotation of eccentric load 76. Proximal end cap 69 (and that portion of housing 580 corresponding to proximal end cap 69) have a second inside diameter sized to be press fit onto first set of sealed bearings 74. An aperture 87 is formed in proximal end cap 69 (and in the proximal end wall of main housing 580) to permit vibrator shaft 72 to extend therethrough. Vibrator case 14, 514 has an outside diameter 84 greater than or approximately equal to the outside diameter 50 of the components of the isolation unit 18.

In the first embodiment, vibrator 13 is enclosed within a substantially cylindrical vibrator case 14. End cap 82 of vibrator 13 has a flange 83 disposed between an axially extending wall 85 and a tapered end wall. Flange 83 has a diameter approximately equal to the outside diameter of housing 80. Axially extending wall 85 extends longitudinally inwardly from flange 83 of cap 82. Internally, end cap 82 is sized to be press fit onto second set of sealed bearings 78. Thus, axially extending wall 85 of end cap 82 has an inside diameter approximately equal to the outside diameter of sealed bearings 78. Axially extending wall 85 has an outside diameter approximately equal to a first inside diameter of housing 80 and is externally threaded with threads matching internal threads of housing 80. By providing axially extending wall 85 of end cap 82 with a thread and internally threading housing 80, end cap 82 may be screwed into housing 80.

Vibrator 513 is enclosed within a substantially cylindrical vibrator case 514. End cap 582 of vibrator 513 has a solid disk-shaped end wall 583 having a diameter approximately equal to the outside diameter of housing 580. An axially extending wall 585 extends longitudinally inwardly from end wall 583 of cap 582. Axially extending wall 585 has an outside diameter approximately equal to a first inside diameter of housing 580. Internally, end cap 582 is sized to be press fit onto second set of sealed bearings 78. Thus, axially extending wall 585 of end cap 582 has an inside diameter approximately equal to the outside diameter of sealed bearings 78. Illustratively, end cap 582 is press fit into housing 580 to seal the distal end of housing 580. Those skilled in the art will recognize that it is within the scope of the disclosure for housing 580 and end cap 582 to be joined in other manners, such as by providing axially extending wall 585 of end cap 582 with a thread and internally threading housing 580 to permit end cap 582 to be screwed into housing 580.

Internally, main housing 580 is formed to have a first inside diameter sized to permit free rotation of eccentric load 76 and a second inside diameter adjacent the proximal end of housing 580 sized to be press fit onto first set of sealed bearings 74. Thus, first inside diameter of housing 580 is slightly greater than twice the distance that the eccentric load 76 extends radially beyond shaft 72 to permit free rotation of eccentric load 76 within housing 580. An aperture 87 is formed in proximal end wall 589 of main housing 580 to permit vibrator shaft 72 to extend therethrough. Illustratively aperture 87 is threaded to receive external threads on second rigid shaft case portion 20. Vibrator case 514 has a maximum outside diameter 84 greater than or approximately equal to the outside diameter 50 of the components of the isolation unit 18. It is within the scope of the disclosure for proximal end of housing 580 or proximal cap 69 to have its outer wall formed to have a smaller diameter or to include a hex shaped outer wall. A hex shaped outer wall facilitates use of a wrench when coupling vibrator case 14, 514 to second rigid shaft case 20.

Flexible shaft or cable 15 may include a cylindrical central portion extending between ends shaped to facilitate coupling cable to engine shaft and vibrator 13. Flexible shafts 15 available from Elliott Manufacturing, Binghampton, N.Y. are typically formed with ends having a square cross-section, thus in the illustrated embodiment, a cavity 81 having a square shaped cross-section is formed to extend longitudinally into the center of shaft 76. Thus, the square shaped end of flexible shaft or cable 15 can be simply slid into cavity 81 of shaft 76 to couple vibrator to flexible shaft or cable 15. Those skilled in the art will recognize that other methods of coupling vibrator 13 to flexible shaft 15 are within the scope of the present disclosure.

It is believed that the presence of sealed-bearings 74 and 78 in vibrator 13 enhances the ability of a gas powered small engine to provide sufficient torque and angular velocity so that a vibrator 13 driven thereby can be used to vibrate finishing tools and as a submersible consolidation vibrator. Illustratively, sealed bearings 74, 78 are NSK bearings available from Motion Industries as part number 6202VVC3. Those skilled in the art will recognize that other sealed bearing may be used within the teaching of the disclosure. The use of sealed bearings 74, 78 in the illustrated vibrators 13 is believed to permit the use of much larger eccentrics 75, 675 that will consolidate larger areas of concrete much faster.

It is within the scope of the disclosure to provide vibrators and vibrator cases of different diameters and length that are adapted for coupling to the second rigid shaft case portion of the vibratory power unit 10 or to a flexible extension that is in turn coupled to the vibratory power unit 10 to permit a user to select the appropriate vibrator for his needs. It is within the scope of the disclosure to provide a vibrator case approximately the same diameter as, but is substantially longer than, vibrator case 14 permitting a longer eccentric (not shown) to be used with vibrator case. Because of the additional length of the eccentric (not shown) used in the elongated vibrator case, greater vibratory power is generated than by vibrator 13 in case 14. The same increase in vibratory power can be realized by increasing the diameter of the eccentric and the case holding the eccentric.

Figure 1:
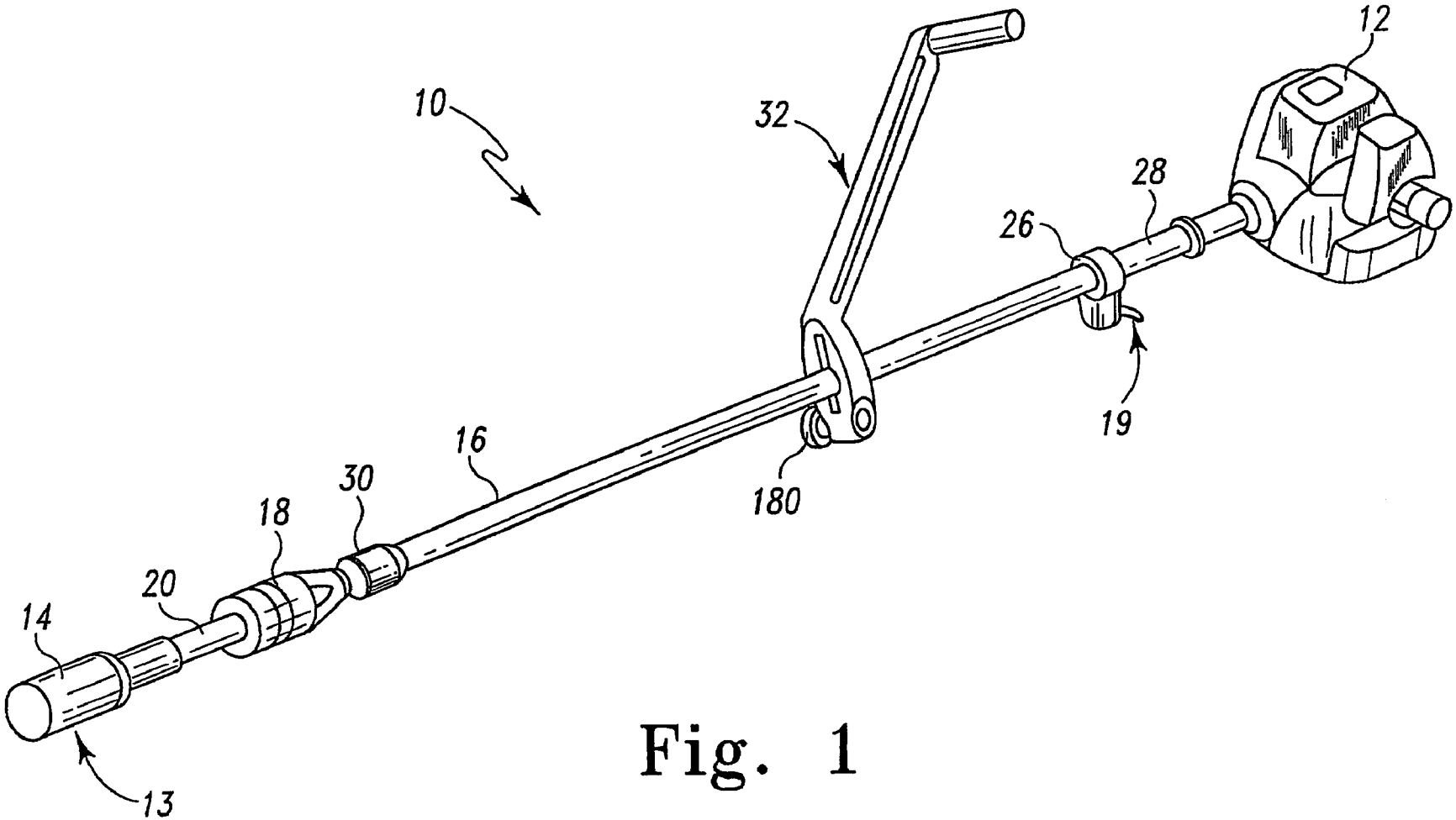
FIG. 1 is a perspective view of a vibratory power unit having an internal combustion engine, a first rigid shaft case portion coupled through an isolation unit with a second rigid shaft case portion to which a vibrator is coupled, a lever control lift handle is shown releasably coupled to the first shaft case portion.
Figure 2:
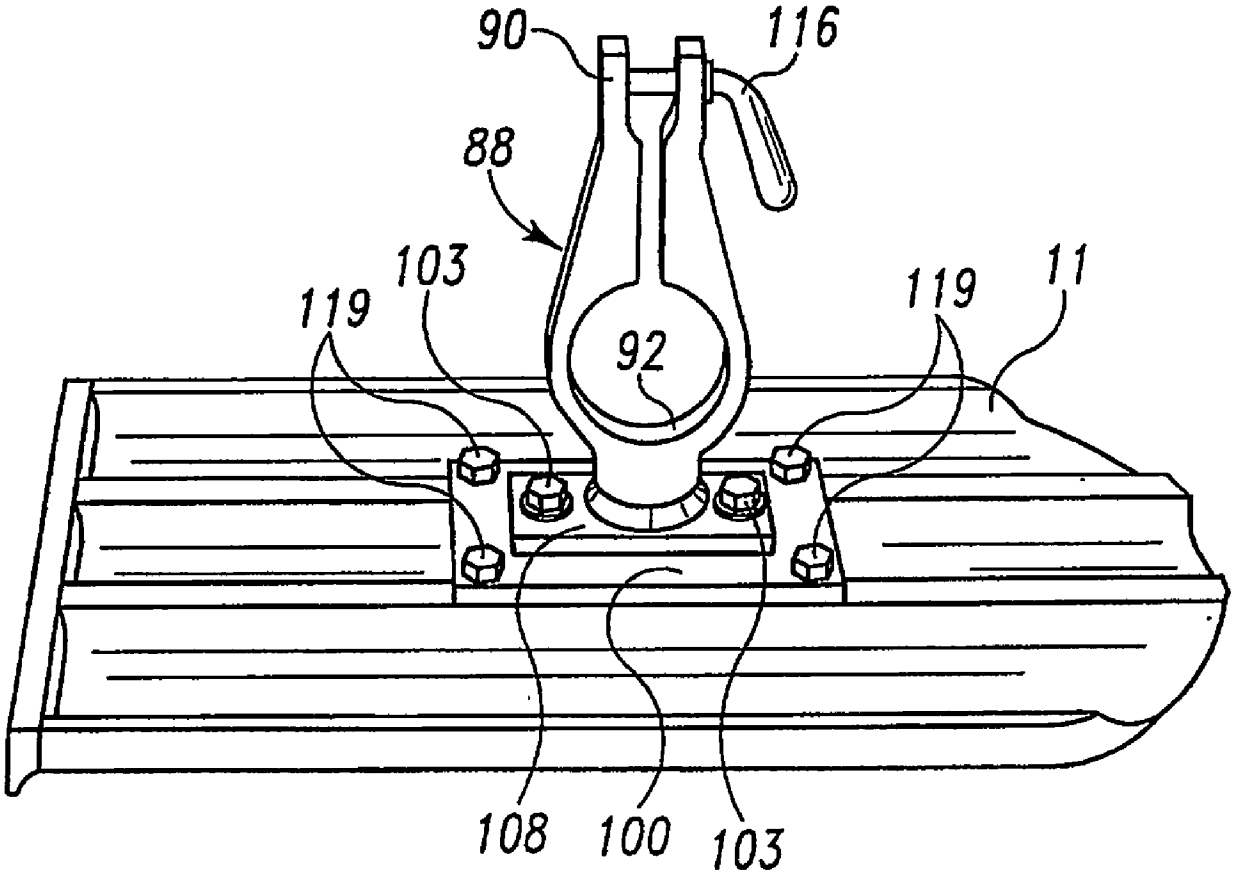
FIG. 2 is a perspective view of a concrete finishing tool, illustratively an edging tool, and a split mounting ring assembly of a coupling for attachment to the vibrator case of the vibratory power unit of FIG. 1.

Vibratory power unit 10, in clean configuration, as shown, for example in FIG. 1, acts as a concrete vibrator or a piercer and may be used for other applications within the scope of the disclosure. When used as a concrete vibrator, as shown, for example, in FIG. 6, vibrator case 14 is dipped into freshly poured concrete and the vibration generated by the vibrator 13 driven by internal combustion engine 12 aids in consolidating the concrete. Because first rigid shaft case portion 16, second rigid shaft case portion 20 and isolation unit 18 form a substantially rigid assembly, the user is able to control precisely the location of the vibrator case 14 to properly consolidate the concrete.

When used as a piercer, the substantially rigid assembly of first rigid shaft case portion 16, second rigid shaft case portion 20 and isolation unit 18 is placed at the desired angle of the hole to be formed and vibrator case 14 is placed in contact with the ground. User guides the vibrator case 14 as it pierces the ground and controls the speed of vibration with trigger throttle control 19. In the illustrated embodiment, eccentric load 76 of vibrator 13 rotates about an axis concentric with the longitudinal axis of vibrator case 14. Thus, the vibrations generated by vibratory power unit 10 are perpendicular to the longitudinal axis of vibrator case 14. Thus, the vibrations of the piercer are perpendicular to the path of penetration of the piercer and are believed to urge the soil away from the vibrator case 14 and compact the soil into the walls of the hole formed by the piercer perpendicular to the longitudinal axis of the hole being formed. Standard piercers that drive themselves into the ground tend to compact the soil in the direction of motion thus causing the piercer to penetrate compacted soil. This compaction in the direction of motion is believed to be substantially reduced when the described vibratory power unit 10 is used as a piercer resulting in improved performance.

In the illustrated embodiment, because the outside diameter 50 of the isolation unit 18 is equal to or less than the diameter 84 of vibrator case 14, isolation unit 18 may be inserted into the hole formed by the piercer without interfering with further penetration of the soil or removal of the piercer once the desired depth is reached. It is within the scope of the disclosure for vibratory power unit 10 to be used as a piercer to form holes at any desired angle. Also, as shown, for example, in FIGS. 23–26, vibrator case 514 has a blunt end on distal end cap 582 yet acts to pierce a vertical hole. Vibrator case 14 includes a tapered end on end cap 82 to facilitate piercing. It is within the scope of the disclosure to provide an attachment to vibrator case 514 having a tapered or pointed end.

Alternative forms of coupling 90, 790 are shown in FIGS. 2, 16, 17 and 22 and in FIGS. 10–15, respectively. Coupling 90, 790 is provided for coupling the vibrator case 14 to a concrete finishing tool 11 facilitating the transfer of the vibrations generated by the vibratory power unit 10 to the concrete finishing tool 11. Portions of these couplings 90, 790, particularly split ball adapter 92 and split mounting ring 110, are virtually identical and will be identified with identical reference numerals.

As shown, for example, in FIGS. 2, 16, 17 and 22, the first embodiment of coupling 90 includes a split-ball adapter 92 and coupling unit 88. Split-ball adapter 92 is ball-shaped with a cylindrical bore 94 extending radially therethrough and a longitudinally extending slit 96. Cylindrical bore 94 has an inside diameter 98 equal to or slightly greater than the outside diameter 84 of vibrator case 14 to facilitate sliding split-ball adapter 92 onto cylindrical vibrator case 14. Cylindrical vibrator case 14 could be formed to include a ball shaped protrusion within the scope of the disclosure to eliminate the need for a separate split-ball adapter 92.

The illustrated embodiment of coupling unit 88 includes a tool mount bar 100 and a split mounting ring assembly 102. Tool mount bar 100 includes a plate 104 for coupling to the finishing tool 11. Plate 104 includes to threaded nut-receiving apertures 105 for receiving nuts 103 for coupling plate 104 to split mounting ring assembly 102.

Illustratively, split mounting ring assembly 102 includes a tool mount plate 108, a split mounting ring 110, ears 112 and 114 and a clamping screw arm 116. Tool mount clamp plate 108 is illustratively welded or otherwise affixed to the bottom of split mounting ring 110 and ears 112 and 114 extend from the top of split mounting ring 110.

Tool mount bar 100 is formed to include a plurality of apertures 118 through which fasteners 119 extend to couple mount bar 100 to a concrete finishing tool 11 such a trowel, a float, an edging tool or a construction joint tool.

Tool mount plate 108 includes a nut receiving holes 124 through which fasteners 103 are received to couple mount plate 108 to tool mount bar 100. It is within the scope of the disclosure for other structure to be used to facilitate clamping or securing of split mounting ring assembly 102 to tool mount bar 100, although it is preferable to eliminate the need for tools in accomplishing the clamping.

In the illustrated embodiment, split mounting ring 110 is welded to tool mount plate 108 so that the center of split mounting ring 110 is centered on mount plate 108. This arrangement facilitates positioning vibrator 13 precisely over the center of the finishing tool 11 when mount bar 100 is properly centered on the tool. Thus vibrations are generated at the center of finishing tool 11. Split mounting ring 110 is oriented at an angle 138, illustratively one hundred and seventeen degrees, relative to tool mount plate 108, as shown, for example, in FIG. 17. This angle 138 facilitates the coupling of vibratory power unit 10 to finishing tool 11 in a manner that will position the vibratory power unit 10 at a height facilitating use of the tool by an operator. The angle of the longitudinal axis of vibratory power unit relative to the finishing tool may be modified, illustratively by twenty one degrees upwardly, to either side or downwardly, as a result of the configuration of the illustrated split-ball 92 and coupling unit 88 of coupling 90.

Split mounting ring 110 is formed to have an inside diameter slightly greater than the outside of split-ball adapter 92. The inside wall of split mounting ring 110 has a shape conforming to the shape of the outside wall of the split-ball adapter 92 to permit split-ball adapter 92 to be inserted into split mounting ring 110, as shown, for example, in FIG. 17. Two ears 112, 114 are positioned on each side of the slit 140 in the split mounting ring 110 of split mounting ring assembly 102. Illustratively, ears 112, 114 extend upwardly from the split mounting ring 110. Holes 142, 144 are provided in ears 112, 114, respectively. In the illustrated embodiment, the threaded shaft 146 of clamping screw arm 116 extends freely through hole 142 across void 147 between ears 112 and 114 and is threadingly received in internally threaded hole 144 in ear 114. As arm 116 is turned clockwise, threads and protrusion 148 cooperate to urge ears 112, 114 together thereby narrowing the width of slit 140 and effectively decreasing the inside diameter of ring 110. The conformal walls of ring 110 engage the surface of split-ball adapter 92 causing slit 96 in split-ball adapter 92 to narrow and effectively reduce the inside diameter of central aperture 94 of split-ball adapter 92. Thus, when the vibrator case 14 is received in central aperture 94 of split-ball adapter 92, tightening of screw arm 116 on the split mounting ring assembly 102 secures split mounting ring 110 to split-ball adapter 92 and secures the split-ball adapter 92 to the vibrator case 14.

Because the internal wall of the mounting ring 110 conforms to the surface of the split-ball adapter 92, the orientation of the split mounting ring 110 can be fixed, within limits, with respect to the distal portion of the shaft case. This feature permits the angle in the vertical plane between the vibratory power unit 10 and the work surface of a tool 11 attached to coupler 90 to be adjusted by the user to a desired or optimal angle for finishing concrete. It also permits the angle in the horizontal plane between the longitudinal axis of the vibratory power unit 10 and the longitudinal axis of the finishing tool 11 to be adjusted by the user to a desired or optimal angle for finishing concrete. For instance, when edging concrete, as shown, for example, in FIG. 3, the user will typically walk outside of the forms in which the concrete is poured to avoid marring the concrete finish. Coupling 90 permits the user to adjust the angle in the horizontal plane between the longitudinal axis of the vibratory power unit 10 and the longitudinal axis of the finishing tool 11 to provide an offset.

As shown, for example, in FIGS. 10–15, coupling 790 is provided for coupling the vibrator case 14 to a concrete finishing tool 11 facilitating the transfer of the vibrations generated by the vibratory power unit 10 to the concrete finishing tool 11. In the illustrated embodiment, coupling includes a split-ball adapter 92 and coupling unit 788. Split-ball adapter 92 is ball-shaped with a cylindrical bore 94 extending radially therethrough and a longitudinally extending slit 96. Cylindrical bore 94 has an inside diameter 98 equal to or slightly greater than the outside diameter 84 of vibrator case 14 to facilitate sliding split-ball adapter 92 onto cylindrical vibrator case 14. Those skilled in the art will recognize that cylindrical vibrator case 14 could be formed to include a ball shaped protrusion within the scope of the disclosure to eliminate the need for a separate split-ball adapter 92.

The illustrated embodiment of coupling unit 788 includes a tool mount bar 700 and a split mounting ring assembly 702. Tool mount bar 700 includes a plate 704 for coupling to the finishing tool and a stud 706 for coupling to split mounting ring assembly 702. Illustratively, split mounting ring assembly 702 includes a tool mount clamp plate 708, a plate screw knob 709, a split mounting ring 110, ears 112 and 114 and a clamping screw knob 716. Tool mount clamp plate 708 is illustratively welded or otherwise affixed to the bottom of split mounting ring 110 and ears 112 and 114 extend from the top of split mounting ring 110.

Tool mount bar 700 is formed to include a plurality of apertures 718 through which fasteners (not shown) extend to couple mount bar 700 to a concrete finishing tool 11 such a trowel, a float, an edging tool or an expansion joint tool. Stud 706 extends upwardly from plate 704 and includes an octagonal portion 720 near the top of stud 706. Opposite walls of octagonal portion 720 are separated by a displacement 722. When attached to a concrete finishing tool 11, tool mount bar 700 is preferably positioned to locate stud 706 equidistant from the ends of the finishing tool 11.

Tool clamp mount plate 708 includes a diamond shaped aperture 724 communicating with a slit 726 communicating with a void 728 formed between two ears 730, 732. The walls of diamond shaped aperture 724, prior to urging ears 730, 732 toward each other, are displaced by a displacement 725 slightly greater than displacement 722 between opposite walls of octagonal portion 720 of stud 706 on tool mount bar 700. Each ear 730, 732 is formed to include a receiving hole 734, 736, respectively, through which a threaded shaft of plate screw knob 709, see FIG. 11, extends. Illustratively, knob of screw knob 709 engages rear face 737 of ear 730 and threaded shaft extends freely through receiving hole 734, across void 728 and is threadingly received in internally threaded receiving hole 736 in ear 732. Upon turning knob clockwise, the threads of threaded shaft advance into internally threaded receiving hole 736 in ear 732. Threads and knob cooperate to urge ears 730, 732 toward each other across void 728 inducing slit 726 to close and the displacement 725 between opposite walls of diamond shaped aperture 724 to narrow. Thus when properly aligned, in one of eight possible orientations, octagonal portion 720 of stud 706 can be received in diamond shaped aperture 724 and split mounting ring assembly 702 can be clamped to tool mount bar 700 by turning screw knob 709. Those skilled in the art will recognize that other structure may be used to facilitate clamping or securing of split mounting ring assembly 702 to tool mount bar 700, although it is preferable to eliminate the need for tools in accomplishing the clamping. The described screw knob 709, and other screw knobs 716 and 180 described herein are preferably designed to provide sufficient leverage for securely clamping components together while eliminating the need for separate tools to accomplish the clamping. Those skilled in the art will recognize that each finishing tool 11 desired to be used with vibratory power unit 10 may include a tool mount bar 700 coupled thereto, or may be formed to incorporate an integral stud and octagonal portion within the scope of the invention. Providing each tool 11 with an octagonal portion 720 facilitates rapid transition between various finishing tools 11. It is also within the scope of the disclosure for stud 706 and aperture 724 to take on other conforming shapes or include interlocking splines.

Figure 13:
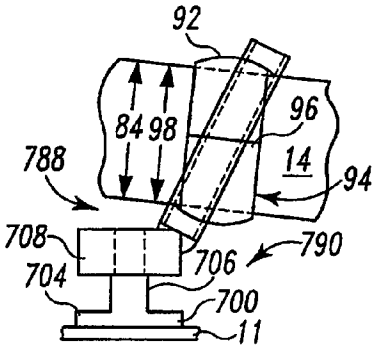
FIG. 13 is a side elevation view with parts broken away of the split mounting ring assembly and split-ball adapter of FIG. 11 with the case of a vibrator received therein.
Figure 11:
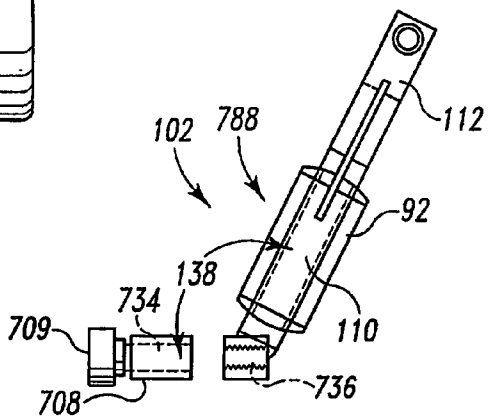
FIG. 11 is a side elevation view of the split mounting ring assembly of FIG. 10 with the screw knob removed for clarity and a split-ball adapter received in the split mounting ring.
Figure 12:
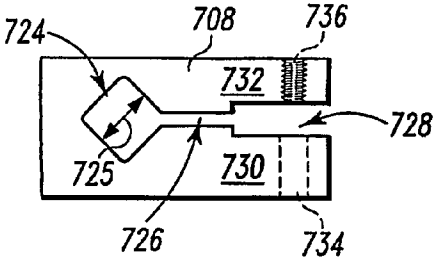
FIG. 12 is a plan view of the tool mount clamp plate of FIG. 10 with screw knob removed for clarity.
Figure 10:
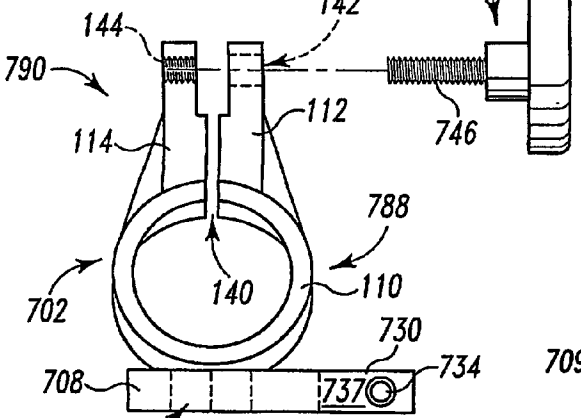
FIG. 10 is rear elevation view of a split mounting ring assembly of an alternative coupling showing a tool mount clamp plate, a split mounting ring, ears and a clamping screw knob.
Figure 16:
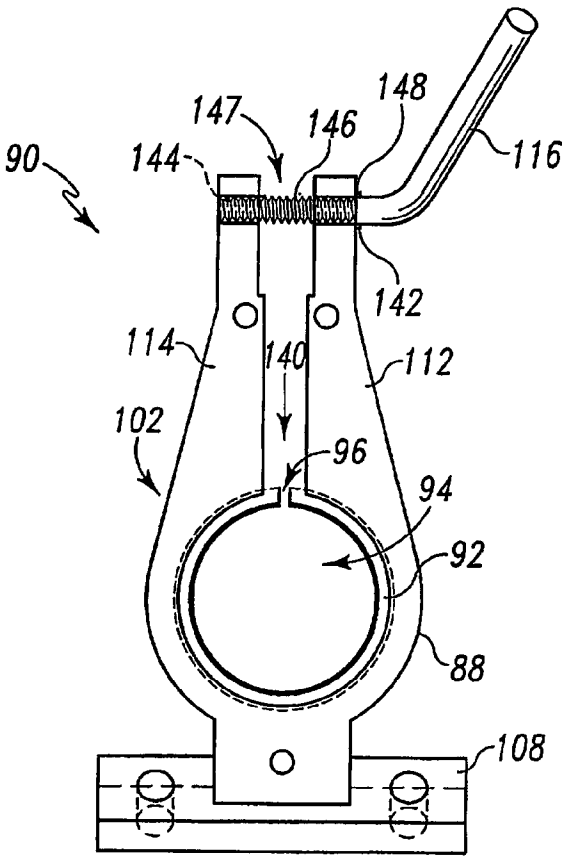
FIG. 16 is rear elevation view of a split mounting ring assembly of the coupling of FIGS. 3–5 showing a split ball adapter, a tool mount plate, a split mounting ring, ears and a clamping screw arm.
Figure 17:
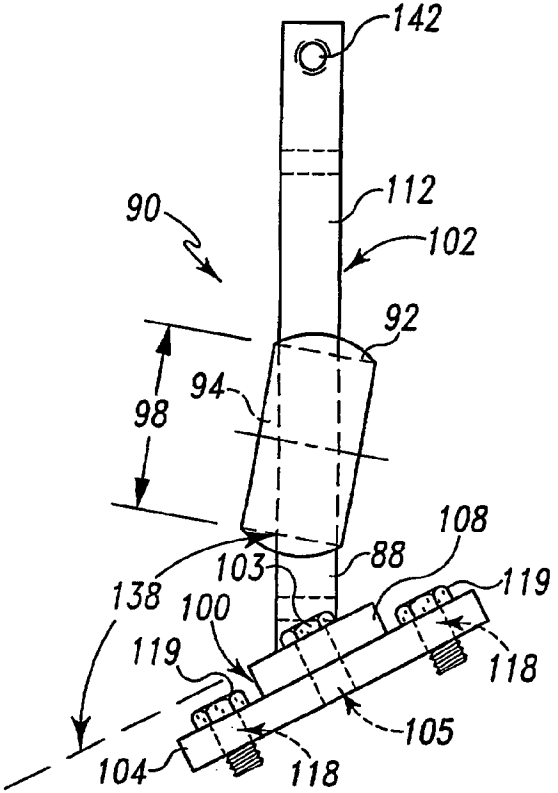
FIG. 17 is a side elevation view of the split mounting ring assembly of FIG. 16 with the screw arm removed for clarity and a split-ball adapter received in the split mounting ring.

In the illustrated embodiment, split mounting ring 110 is welded to tool mount clamp plate 708 so that the center of split mounting ring 110 is aligned with the center of diamond shaped aperture 724. This arrangement facilitates positioning vibrator 13 precisely over stud 706 which is preferably centered between the ends of the finishing tool 11 to which mount bar 700 is attached. Thus vibrations are generated at the center of finishing tool 11. Split mounting ring 110 is oriented at an angle 138, illustratively one hundred and seventeen degrees, relative to tool mount clamp plate 708, as shown, for example, in FIG. 11. This angle 138 facilitates the coupling of vibratory power unit 10 to finishing tool 11 in a manner that will position the vibratory power unit 10 at a height facilitating use of the tool by an operator. The angle of the longitudinal axis of vibratory power unit relative to the finishing tool may be modified, illustratively by twenty one degrees upwardly, to either side or downwardly, as shown in FIG. 13 as a result of the configuration of the illustrated split-ball 92 and coupling unit 788 of coupling 790.

Split mounting ring 110 is formed to have an inside diameter slightly greater than the outside of split-ball adapter 92. The inside wall of split mounting ring 110 has a shape conforming to the shape of the outside wall of the split-ball adapter 92 to permit split-ball adapter 92 to be inserted into split mounting ring 110, as shown, for example, in FIG. 11. Two ears 112, 114 are positioned on each side of the slit 140 in the split mounting ring 110 of split mounting ring assembly 102. Illustratively, ears 112, 114 extend upwardly from the split mounting ring 110. Holes 142, 144 are provided in ears 112, 114, respectively. In the illustrated embodiment, the threaded shaft 746 of clamping screw knob 716 extends freely through hole 142 across void 147 between ears 112 and 114 and is threadingly received in internally threaded hole 144 in ear 114. As knob 748 is turned clockwise, threads and knob cooperate to urge ears 112, 114 together thereby narrowing the width of slit 140 and effectively decreasing the inside diameter of ring 110. The conformal walls of ring 110 engage the surface of split-ball adapter 92 causing slit 96 in split-ball adapter 92 to narrow and effectively reduce the inside diameter of central aperture 94 of split-ball adapter 92. Thus, when the vibrator case 14 is received in central aperture 94 of split-ball adapter 92, tightening of screw knob 716 on the split mounting ring assembly 702 secures split mounting ring 110 to split-ball adapter 92 and secures the split-ball adapter 92 to the vibrator case 14.

Because the internal wall of the mounting ring 110 conforms to the surface of the split-ball adapter 92, the orientation of the split mounting ring 110 can be fixed, within limits, with respect to the distal portion of the shaft case. This feature permits the angle in the vertical plane between the vibratory power unit 10 and the work surface of a tool 11 attached to coupler 790 to be adjusted by the user to a desired or optimal angle for finishing concrete. It also permits the angle in the horizontal plane between the longitudinal axis of the vibratory power unit 10 and the longitudinal axis of the finishing tool 11 to be adjusted by the user to a desired or optimal angle for finishing concrete. If the inherent limits of the adjustment facilitated by split-ball adapter 92 and split mounting ring 110 in the horizontal direction is not sufficient to accommodate the user, additional horizontal adjustment can be obtained by reorienting octagonal portion 720 of stud 706 within diamond shaped aperture 724 of tool clamp plate 708 of coupling unit 702. For instance, when edging concrete, as shown, for example, in FIG. 3, the user will typically walk outside of the forms in which the concrete is poured to avoid marring the concrete finish. Coupling 790 permits the user to adjust the angle in the horizontal plane between the longitudinal axis of the vibratory power unit 10 and the longitudinal axis of the finishing tool 11 to provide an offset.

It is within the teaching of the disclosure for a variety of concrete finishing tools 11 to be removably affixed to vibratory power unit 10. Coupling 90 is designed to facilitate the transfer of vibrations generated by vibratory power unit 10 to the concrete finishing tool 11. Illustratively, vibratory power unit 10 is releasably coupled to a concrete edging tool 151, as shown, for example, in FIG. 3, a finishing trowel 153 with jointing tool attachment 198 as shown, for example, in FIG. 4, and a screed 155 as shown, for example, in FIG. 6.

As mentioned previously, the illustrated embodiment of vibratory power unit 10 includes a removable lever control lift handle 32 removably coupled to the first rigid shaft case portion 16. Lever control lift handle 32 is designed and arranged to be adjusted to permit the user to counteract rotation of finishing tools when finishing concrete, as shown, for example, in FIGS. 3–5. For instance, when edging concrete with an edging tool 151, there is a tendency for the edging tool 151 to rotate toward the edge of the concrete creating a tapered surface adjacent the edge. It is preferred that such rotation be avoided to eliminate the taper near the edge. Lever control lift handle 32 permits the user, to not only apply vertical forces to the vibratory power unit 10 to aid in bearing the weight of the tool, but also permits the user to counteract rotation of tool 11 by providing a counteracting torque to first rigid shaft case portion 16.

Figure 28:
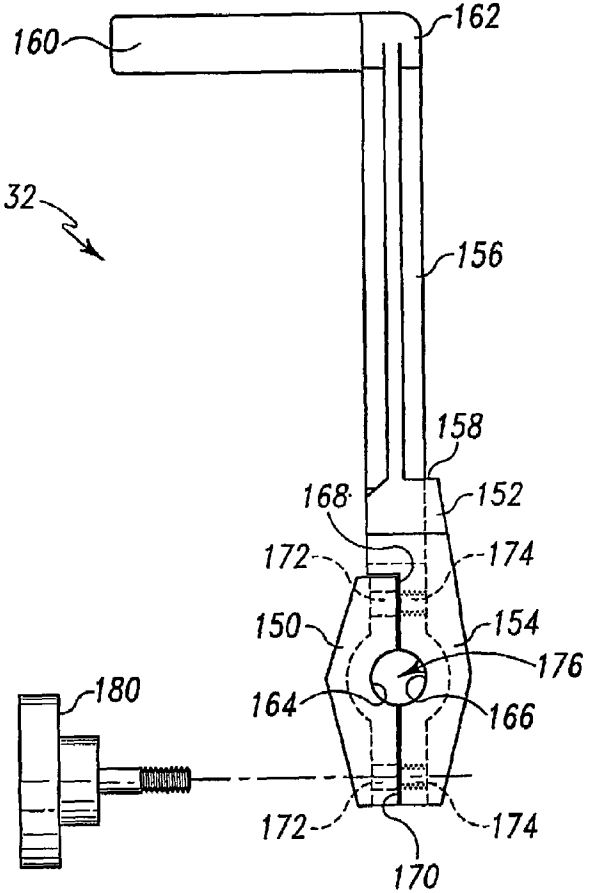
FIG. 28 is a front elevation view of the lever control handle of FIG. 27.
Figure 27:
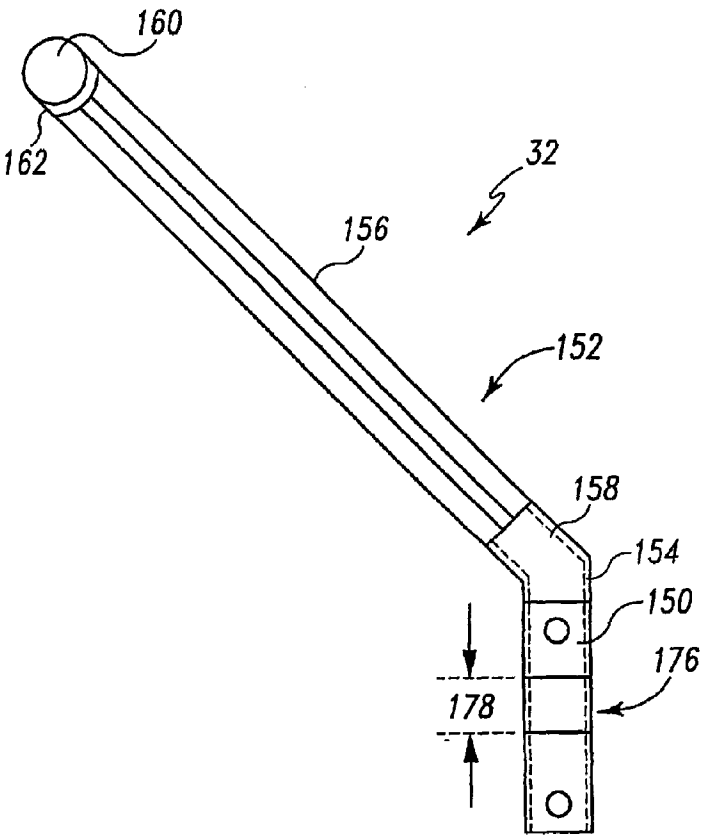
FIG. 27 is side elevation view of the lever control lift handle of FIG. 1.

In the illustrated embodiment, as shown, for example, in FIGS. 27 and 28, lever control lift handle 32 includes a shaft mount half 150 and a handle body 152 configured to couple to shaft mount half 150 to secure lever control lift handle 32 to the first rigid shaft case portion 16. Handle body 152 includes a mount portion 154, an extension shaft 156 coupled at one end 158 to the mount portion 154 and a grip portion 160 coupled to the other end 162 of, and extending perpendicularly from, the extension shaft 156. In the illustrated embodiment, shaft mount half 150 and mount portion 152 each include semi-cylindrical concave walls 164 and 166, respectively, extending from a mating face 168 and 170, respectively. Shaft mount half 150 is formed to include two smooth bore fastener receiving holes 172 extending through the face 168 and body of the shaft mount half 150 on opposite sides of the semi-cylindrical concave wall 164. Similarly, mount portion 154 is formed to include two internally threaded fastener receiving holes 174 extending through the face 170 and body of the mount portion 154 on opposite sides of the semi-cylindrical concave wall 166. Fasteners (not shown in FIGS. 27 and 28) extend through the receiving holes 172, 174 to couple the shaft mount half 150 and mount portion 154 together. When joined, semi-cylindrical concave walls 164, 166 cooperate to form a cylindrical opening 176 sized to receive first rigid shaft case portion 16 therein. Cylindrical opening 176 has an inside diameter 178 approximately equal to the outside diameter 24 of first rigid shaft case portion 16.

Illustratively, receiving holes 174 in mount portion 154 of handle body 152 are threaded to receive the threaded shaft of a bolt or the threaded shaft of a screw knob 180. In the illustrated embodiment, a bolt extends through one corresponding set of receiving holes 172, 174 in the shaft mount half 150 and mount portion 154 and the threaded shaft of screw knob 180 extends through the other corresponding receiving holes 172, 174 of shaft mount half 150 and mount portion 154. When bolt and screw knob 180 are both tightened, the external wall 60 of first rigid shaft case portion 16 is frictionally engaged by the walls 164, 166 of cylindrical opening 176 to clamp lever control lift handle 32 to first rigid shaft case portion 16 of vibratory power unit 10. Friction between external wall 60 of first rigid shaft case portion 16 and walls 164, 166 of cylindrical opening 176 is preferably sufficient to prevent longitudinal and rotational movement of lever control lift handle 32 relative to first rigid shaft case portion 16. The user can adjust the longitudinal position and angle of lever control lift handle 32 relative to first rigid shaft case portion 16 by loosening screw knob 180, positioning lever control lift handle 32 as desired and tightening screw knob 180.

Figure 30:
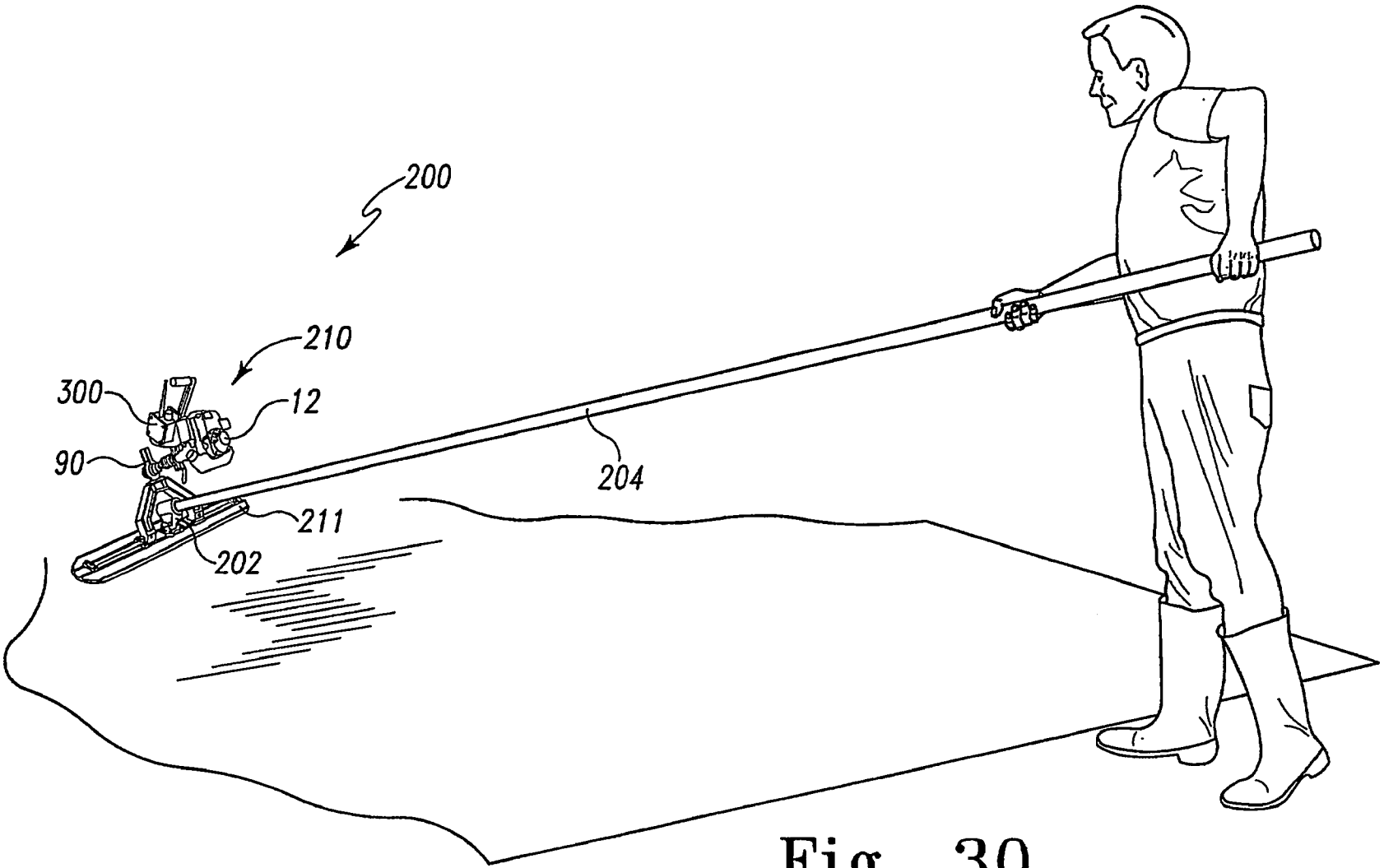
FIGS. 30 and 31 are perspective views of a second embodiment of a vibratory power unit attached by a truss mount to an elongated finishing tool having a lever control attachment coupling a handle to the finishing tool, a remote throttle controller is shown coupled to the vibratory power unit.
Figure 31:
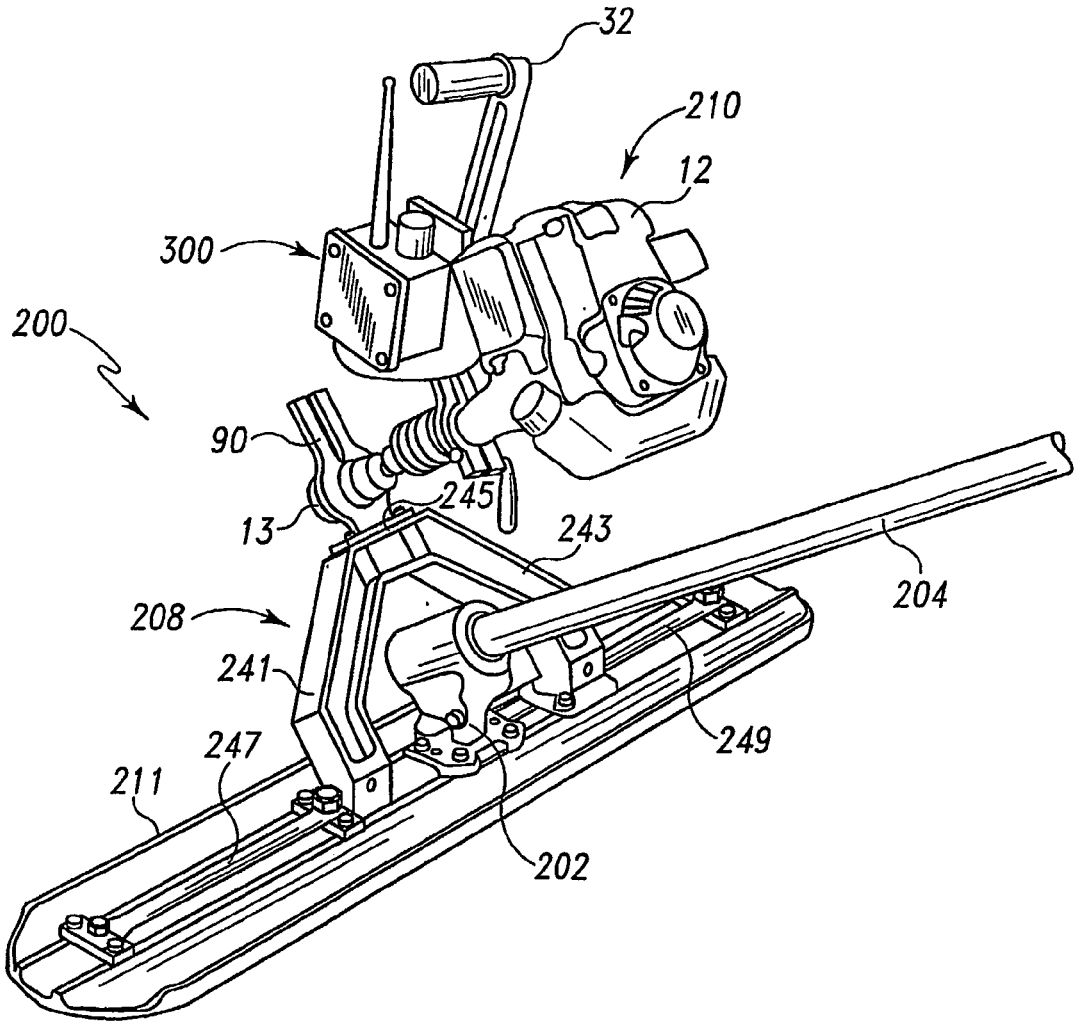
Figure 32:
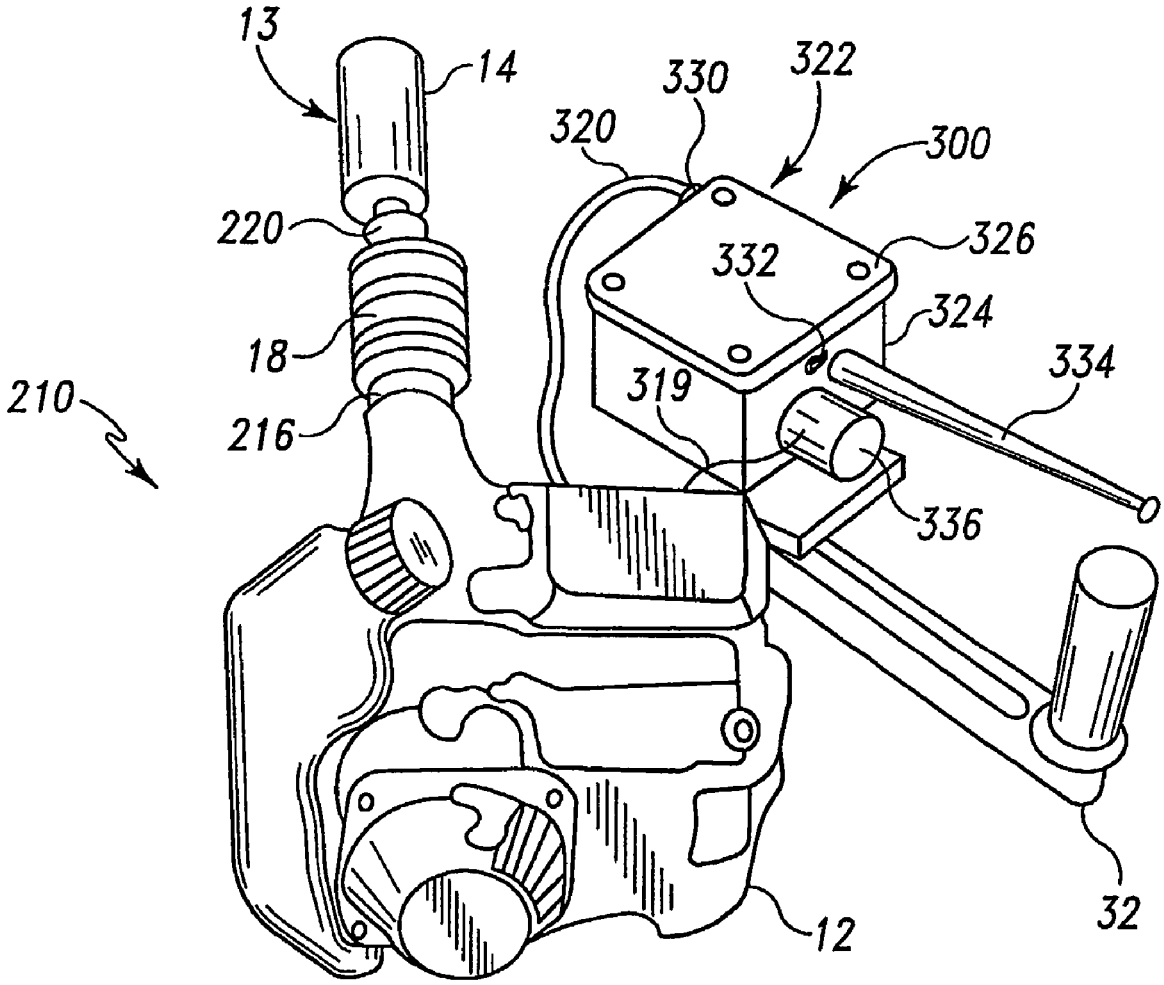
FIG. 32 is a perspective view of the vibratory power unit of FIG. 30.

In an alternative embodiment of a vibrating concrete finishing tool 200 is shown in FIGS. 30–32. A vibratory power unit 210 similar to that described above but with shorter first and second rigid shaft case portions 216, 220 is coupled to an elongated concrete finishing tool, such as a screed or a bull float 211. Engine 12, flexible shaft (not shown) and vibrator 13 are similar to those described above. The flexible drive shaft extends from the engine shaft through a first rigid shaft case portion 216, an isolation unit 18 and a second rigid shaft case portion 220 to the vibrator 13 located within the vibrator case 14.

Elongated concrete finishing tools 211 typically include a lever control attachment 202 which is a gear box that attaches between a finishing tool and handle 204 the finisher uses to push and pull the finishing tool 211 across long distances. As the distance between the user and the finishing tool 211 increases, the angle of handle 204 to the finishing face of finishing tool 211 must be altered to maintain the finishing face of finishing tool 211 flat on the surface of the concrete. Rotation of handle 204 adjusts the angle between handle 204 and the finishing face of the elongated finishing tool 211. Lever control attachments 202 of the type described are known by such tradenames as EZY-Tilt and Knucklehead. Such lever control attachments 202 are preferably mounted so that they are centered between the ends of the elongated finishing tool 211. Vibrations should also be generated at a point centered between the ends of the elongated finishing tool 211.

Vibratory power unit 210 is attached by a split ball adapter coupling 90 of the type previously described above to a truss mount 208 mounted to an elongated finishing tool 211.

Truss mount 208 couples vibratory power unit 210 to elongated finishing tool 211. Truss mount 208 includes two short arms 241, 243 extending outwardly and downwardly from a central portion 245 to elongated finishing tool 211. Truss mount 208 also includes two long arms 247, 249 extending outwardly and slightly downwardly from short arms 241, 243, respectively, to elongated finishing tool 211. Illustratively, split ball adapter coupling 90 is mounted by fasteners directly to central portion 245 of truss mount 208 without using mount bar 100. Split ball adapter coupling 90 permits radio controlled vibratory power unit 210 to be removed from elongated finishing tool 211 as a unit so that it may be coupled to other finishing tools configured to receive a vibratory power unit. Split ball adapter coupling 90 also permits the angle of vibratory power unit 210 relative to elongated finishing tool 211 to be adjusted within limits to optimize transfer of vibrations generated by vibrator 13 to elongated finishing tool 211.

Illustratively, lever control attachment 202 is bolted directly to the center of elongated finishing tool 211. Lever control attachment may also be isolated from the vibrations transferred to elongated finishing tool 211 within the scope of the disclosure. Rubber grommets may be sandwiched between lever control attachment 202 and elongated finishing tool 211. Fasteners may extend through lever control attachment 202 and grommets to couple lever control attachment 202 to elongated finishing tool 211.

It is within the scope of the disclosure for other mounting means to be used to mount both a vibratory power unit 210 and a lever control attachment 202 in a position centered between the ends of an elongated power tool 211. For instance, an A-frame mount may be provided for mounting both a vibratory power unit 210 and a lever control attachment 202 in a position centered between the ends of an elongated power tool 211.

The A-frame mount would include four laterally extending arms coupled to the concrete finishing tool 211. In such a mount, two long arms would extend from the apex of the A-frame mount toward opposite ends of the elongated finishing tool 211 to which the ends of long arms would be coupled. Two short arms would extend from the apex of the A-frame mount to opposite sides of the center of the elongated finishing tool 211 to which the ends of the short arms would be attached. In such a mount, a cross member 235 would extend between the two short arms. A vibrator mount, such as a coupling 90, would extend from the cross member to provide a mounting location for the vibrator case 14. The engine 12 of the vibratory power unit 210 would be mounted to the apex of A-frame mount to position it above lever control attachment 202. The flexible shaft and shaft case 220 of vibratory power unit 210 would extend downwardly from the engine 12 to vibrator 13 held within vibrator case 14 which is mounted adjacent the elongated finishing tool 211 to transfer vibrations to the finishing tool 211.

As shown, for example, in FIG. 31, since the vibratory power unit 210 and elongated finishing tool 211 are pushed as a unit across the concrete using elongated handle 204, the user is not able to use a trigger throttle control 19 as described above to control vibration frequency. It is within the scope of the disclosure for a separate throttle cable to be attached to engine 12. Separate throttle cable can be used by a helper to increase and decrease the RPMs of the engine 12 and thereby increase and decrease the frequency of vibrations.

In the illustrated embodiment, throttle control is accomplished remotely by the user operating a wireless remote control which controls servo-motors or other actuators of a radio controlled throttle unit 300 coupled to the throttle of the engine 12. Illustratively, radio controlled throttle unit 300 is coupled to lever arm 32 that is coupled to first rigid shaft case portion 216. Since first rigid shaft case portion 216 is isolated by isolator 18 from vibrations generated by vibrator 13, radio controlled throttle unit 300 is also isolated from vibration. It is within the scope of the disclosure to further isolate radio controlled throttle unit 300 from vibration by disposing grommets between radio controlled throttle unit 300 and handle 32.

Alternative means of mounting radio controlled throttle unit 300 to vibratory power unit 210 are also within the scope of the disclosure. For instance, a U-shaped bracket having upwardly extending arms may be mounted directly to first rigid shaft case portion 216. As previously mentioned, first rigid shaft case portion 216 is isolated from vibrations generated by vibrator 13 by isolation unit 18. Thus, U-shaped bracket would be isolated by isolation unit 18 from vibrations generated by vibrator 13. Each upwardly extending arm may be formed to include attachment holes through which fasteners extend to mount radio control unit 300 to the bracket. Fasteners would extend through ears extending from case of radio control unit 300. Rubber grommets could be sandwiched between the ears and upwardly extending arms to further isolate radio control unit 300 from vibrations generated by vibrator 13.

Those skilled in the art will recognize that rubber grommets may be sandwiched between ears of case of radio control unit 300 and the central portion of an A-frame mount if it is desired to mount the radio control unit 300 directly to the mount instead of the vibratory power unit 210. The rubber grommets would serve to isolate the electrical components of radio control unit 300 from vibrations transferred to elongated finishing tool 211 by vibrator 13. This extends the life of radio control unit 300.

Since the internal combustion engines 12 of the type described above do not include a separate battery, generator or alternator, electrical power generated by engine 12 to provide spark for the magneto stop circuit is scavenged from the engine 12 to eliminate the need of providing a separate power supply to the servo-motors or other actuators manipulating the throttle. However, as shown in the alternative embodiment illustrated in FIGS. 34–36, it is within the teaching of the disclosure for servo motor power to be provided by an on board power supply such as a battery. Additionally, as shown in FIGS. 39–42, it is within the teaching of the disclosure for servo motor power to be provide by power scavenged from engine 12 and supplemented by an on board power supply. It is also within the teaching of the disclosure for the mechanical power generated by the engine to be harnessed to generate the required electrical power for driving the servo motors.

One example of such a radio controlled throttle unit 300 is shown in FIGS. 30–43. As shown for example in FIGS. 31–32, radio controlled throttle unit is coupled a handle 32 of engine 12. A throttle cable 319 communicates between radio controlled throttle unit 300 and the throttle controls of engine 12. An electrical cable 320 extends from the remote controlled throttle unit 300 to the magneto stop circuit (not shown) of the engine 12.

Radio controlled throttle unit 300 includes a housing 322 having a cover 324 and a base 326 and a P.C. board 328 (shown in FIG. 33). An electrical connector 330, a switch 332, an antenna 334 and a clutch body 336 extend through cover 324. P.C. board 328 is mounted with standoffs to base 326 of housing 322.

Illustratively, switch 332 is a 3-position function switch having three positions labeled STOP, START and RUN. When in the STOP position, switch 332 shorts the red and black engine controller power supply leads. This stops a running engine. When switch 332 is in the START position, the engine controller power supply leads are not connected to anything and are not shorted together. Switch 332 is placed in START position when starting the engine. When switch 332 is in the RUN position, the engine controller power supply leads are connected to the internal circuitry of the unit and, if power is being applied to these leads, the engine controller 300 receives power.

As previously stated, the illustrated embodiment of radio controlled throttle controller 300 utilizes the low voltage component of the magneto stop circuit to provide power to the internal circuitry of the unit and the servo motor. Electrical cable 320 from magneto stop circuit is coupled to electrical connector 330 which is coupled to P.C. board 328.

The components on P.C. board 328 are basically divided into three functional circuit blocks. They are a switch mode power supply circuit 350 which takes up the bulk of the circuit board real estate (see FIG. 33*a*), a Lynx brand radio receiver module 352 (see FIG. 33*b*), and a microcontroller/motor driver circuit 354.

Microcontroller/motor driver circuit 354 provides the intelligence in the product. As shown, for example, in FIG. 33*b*, microcontroller/motor driver circuit 354 includes microcontroller 358, two Half-Bridge semi conductors 360, 362, a terminal block 364, a transient voltage suppressor 366 and a plurality of light emitting diodes 368, diodes 370, zener diodes 372, and appropriate biasing and filtering resistors 374 and capacitors 376. Illustratively, microcontroller 358 is an EPROM based 8-bit CMOS microcontroller, available from Digi-Key as part number PIC 16C622A-041/P-ND. Half bridges 360, 362 are complementary MOSFET, SMT, half bridge Fairfield semiconductors available from Digi-Key as part number NDS8858HCT-ND. Transient voltage suppressor is illustratively a 15 volt, 500 Watt Transient Voltage Suppressor, Pheonix Contact 1725656 available from Digi-Key as part number 277-1273-ND. Those skilled in the art will recognize that other components may be used within the teachings of the disclosure.

Figure 33A:
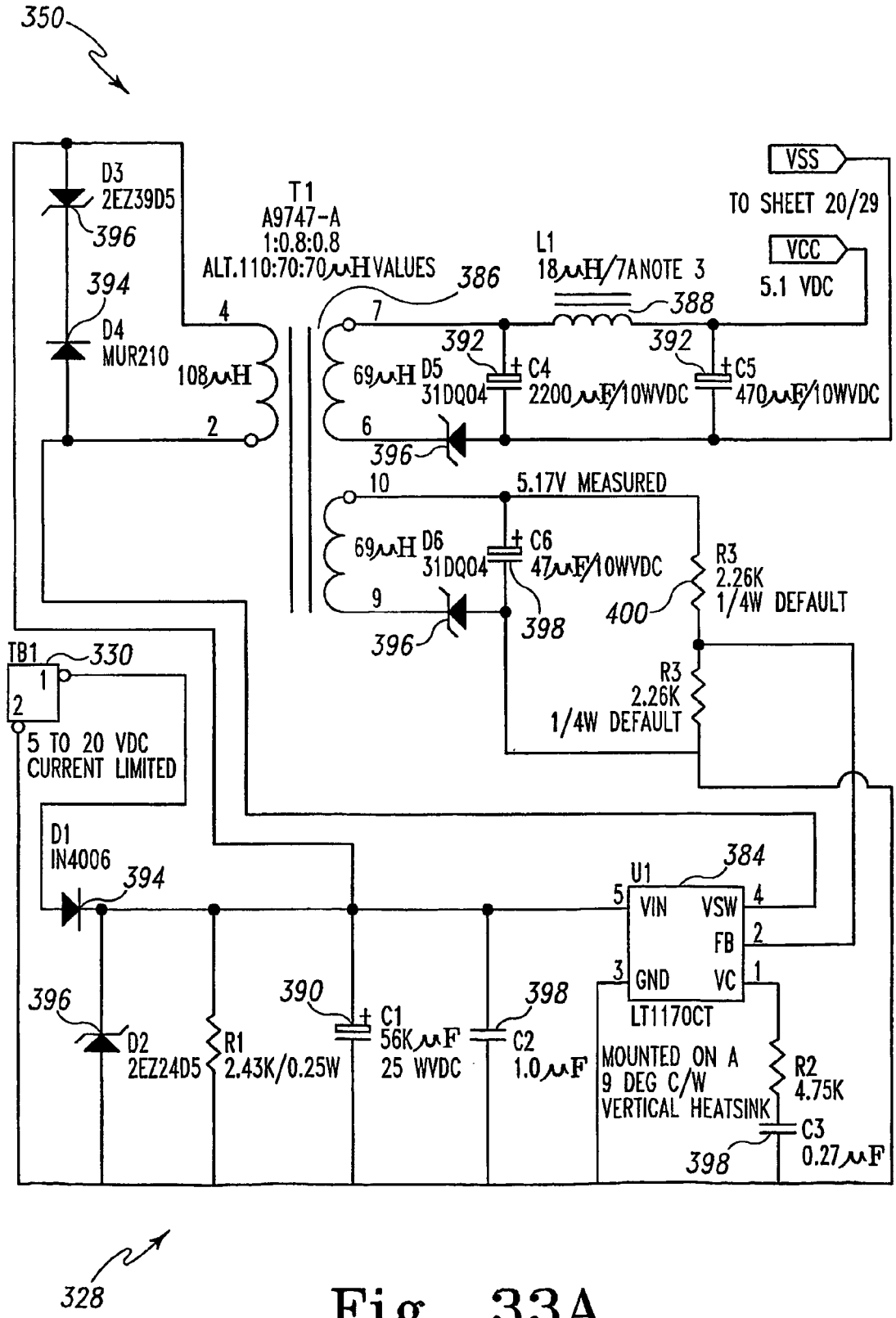
FIGS. 33*a* and *b* are a schematic diagram of the radio controlled throttle unit of FIG. 30.
Figure 33B:
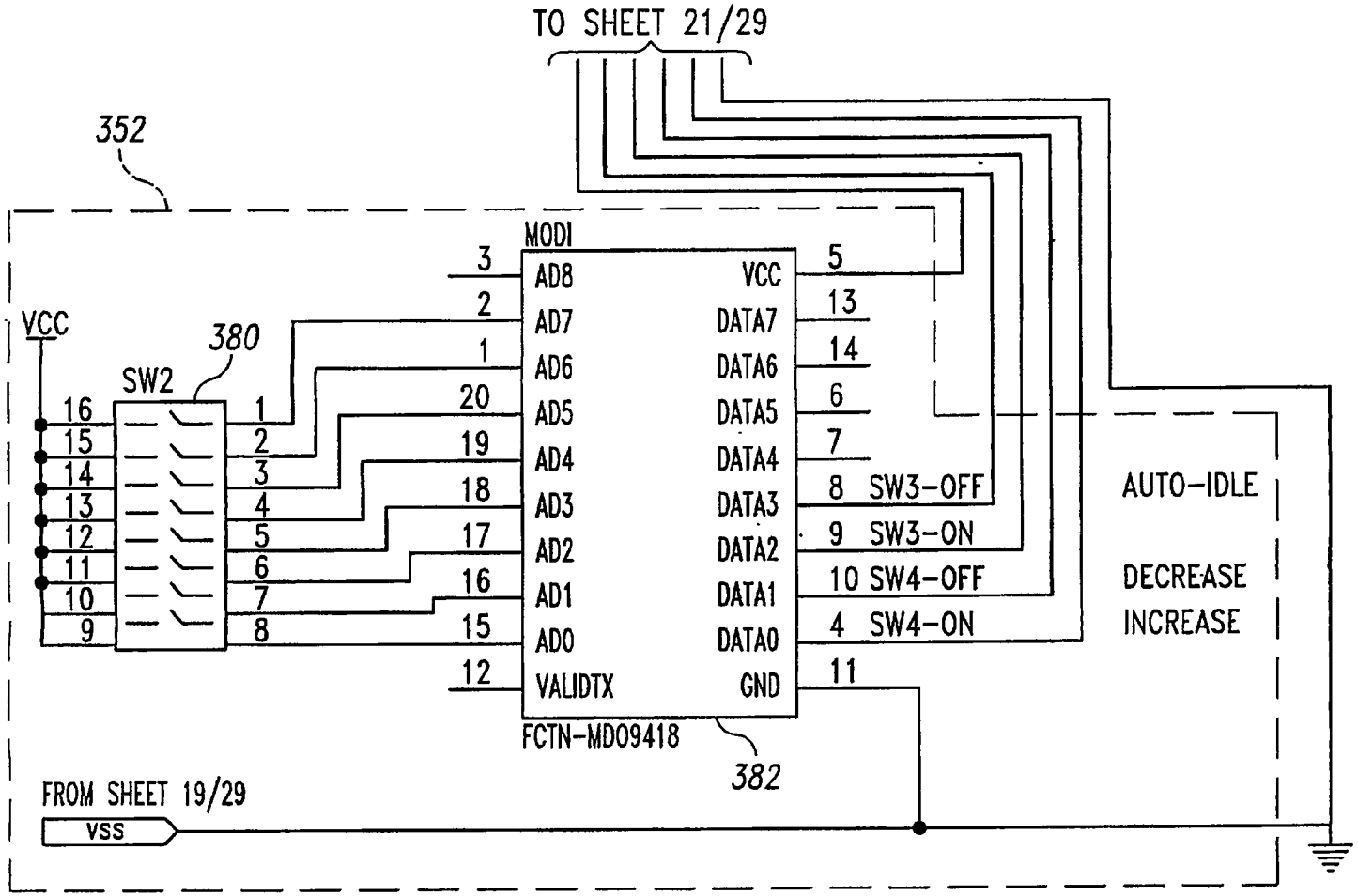

As shown, for example, in FIG. 33*b*, microcontroller/motor drive circuit 354 is coupled to power supply circuit 350 to receive its power and to radio receiver module 352 for receiving control signals. The output of microcontroller/motor drive circuit 354 is coupled to capacitively coupled flying leads of motor 356. In the illustrated embodiment, motor 356 is a Henkwll-KG37B2-500-12, 12VDC/12 RPM/1:500 gearmotor. Microcontroller/motor drive circuit 354 responds to input from the radio receiver 352 and decides which way to rotate the motor 356 and for how long to rotate it. This circuitry also applies dynamic (electrical) braking to the motor so that it stops rapidly when commanded to do so rather than coasts to a stop. Microcontroller 358 is appropriately programmed to properly control the motor 356 in response to input from radio receiver 352.

As shown for example, in FIG. 33*b*, radio receiver module 352 includes an eight position DIP switch 380 and a receiver and decoder module 382. Receiver and decoder module 382 is a purchased, FCC CFR47, part 15 approved part. Illustratively, receiver and decoder module 382 is an OEM, RF receiver and decoder module available from Lynx Technologies as part number FCTN-MD09418. DIP switch 380 controls the frequency upon which receiver and decoder module 382 operates. While not shown in FIG. 33*b*, antenna 334 is coupled to pin 12 VALIDTX of receiver and decoder module 382. Thus, receiver and decoder module 382 receives the data that is broadcast from the remote control transmitter 318, also a purchased FCC CFR47, part 15 approved part, which is set to operate on the same frequency. Receiver and decoder module 382 decodes this data and presents it to the microcontroller 358. Radio receiver module 352 is coupled to power supply circuit 350 to receive the power necessary for operation.

Power supply circuit 350 is a switch mode power supply (SMPS). In the illustrated embodiment, power supply circuit includes terminal block 330, switching regulator 384, transformer 386, inductor 388, storage and smoothing capacitor 390 filter capacitors 392 and a plurality diodes 394, zener diodes 396, capacitors 398 and resistors 399. In the illustrated embodiment, terminal block 330 is a two position, current limited (5–20VDC) 0.200 pitch PWB mounted terminal block, Pheonix Contact 1729128 available from Digi-Key as part number 277-1247-ND. Switching regulator 384 is a 100 kHZ, 5.0 amp, high efficiency switching regulator available Linear Technology LT 1170, available from Digi-Key as part number LT1170CT-ND. Illustratively, switching regulator 384 is mounted within heat sink 392 to provide sufficient heat dissipation. Transformer 386 is a 1:0.8:0.8 Switching power transformer available from Coilcraft as part number A9747-A. Inductor 388 is a 18 μH, 7.0 amp, bobbin inductor available from Prem Magnetics as part number SPB-104. Storage capacitor 390 is a 56,000 μF, 24 WVDC, 0.015 Ω, electrolytic capacitor available from Panasonic as part number ECE-TIEA563FA.

SMPSs are generally a more efficient type of power supply than other types of power supplies. In the illustrated embodiment, power supply circuit 350 performs three functions.

Firstly, power supply circuit 350 provides regulated electrical power to the internal circuitry (radio receiver module 352 and microcontroller/motor drive circuit 354) of controller 300. Regulation is necessary because the various engines put out different voltage levels depending on engine brand as well as on engine speed. The SMPS design used herein is able to provide a regulated 5 Volts DC to the engine controller internal circuitry (radio receiver module 352 and microcontroller/motor drive circuit 354) regardless of whether the engine 12 is supplying a voltage that is, within limits, higher or lower than 5VDC.

Secondly, the SMPS filters out some of the electrical noise that is present on the power input to the engine controller. Inductor 388 and filtering capacitors 392 cooperate to perform a substantial amount of this filtering.

Thirdly, the SMPS isolates the electrical currents supplied by the engine magneto from the electrical power used inside of the engine controller 300 by radio receiver module 352 and microcontroller/motor drive circuit 354. This is necessary because different brands of engines 12 have different grounded polarity. The radio receiver 352, however, requires a negative ground polarity in order to work properly. (This has to do with the RF ground versus the antenna.) The electrical isolation provided by the SMPS insures that the power used internally in the engine controller 300 is always negative ground regardless of which ground polarity is present on the engine 12 is being used to power engine controller 300.

Figure 38:
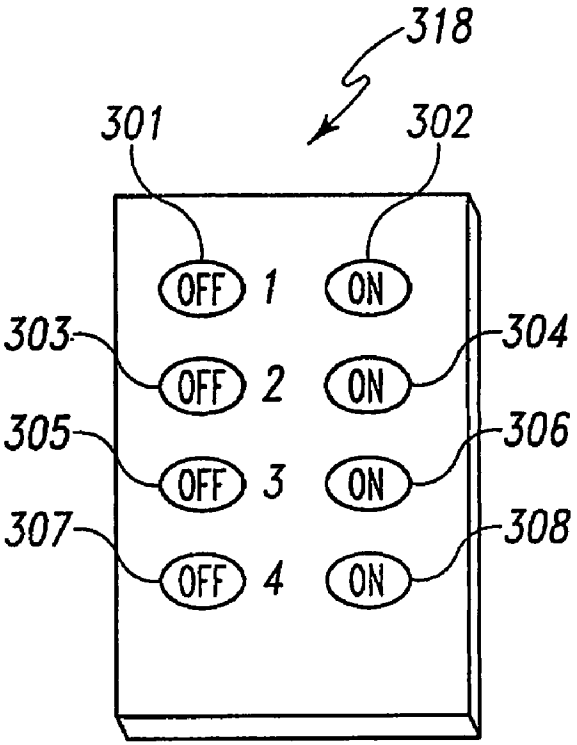
FIG. 38 is a perspective view of a remote control unit for sending commands to a radio controlled throttle unit.

As shown in FIG. 38, handheld remote control transmitter 318 has eight buttons 301–308, however engine controller 300 responds to only three of the buttons. Those skilled in the art will recognize that engine controller 300 could be programmed to respond to additional buttons for additional features or that a handheld remote control transmitter with fewer or more button can be provided.

In the illustrated embodiment, The ON #4 button, or throttle advance button 308 causes the throttle to advance continuously so long as throttle advance button 308 remains depressed. Those skilled in the art will recognize that engine controller 300 could be programmed to increment the throttle one step for each push of throttle advance button 308 within the teaching of the disclosure. Other control algorithms are also within the teaching of the disclosure.

The OFF #4 button or throttle retard button 307 causes the throttle to retard continuously so long as throttle retard button 307 remains depressed. Those skilled in the art will recognize that engine controller 300 could be programmed to decrement the throttle one step for each push of throttle retard button 307 within the teaching of the disclosure. Other control algorithms are also within the teaching of the disclosure.

The OFF #3 button or throttle idle button 305 causes the throttle to retard fully to idle (auto idle) for each push of this button.

Figure 37:
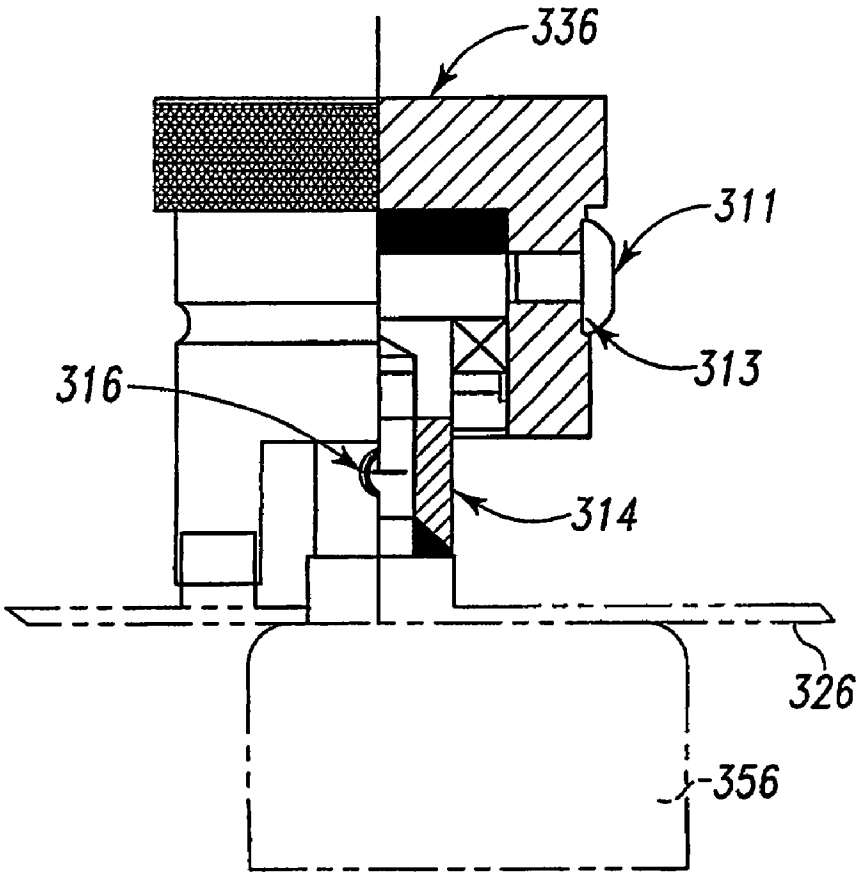
FIG. 37 is a side elevation view with parts broken away of the clutch body, case and motor of the radio controlled throttle unit of FIG. 35.
Figure 39:
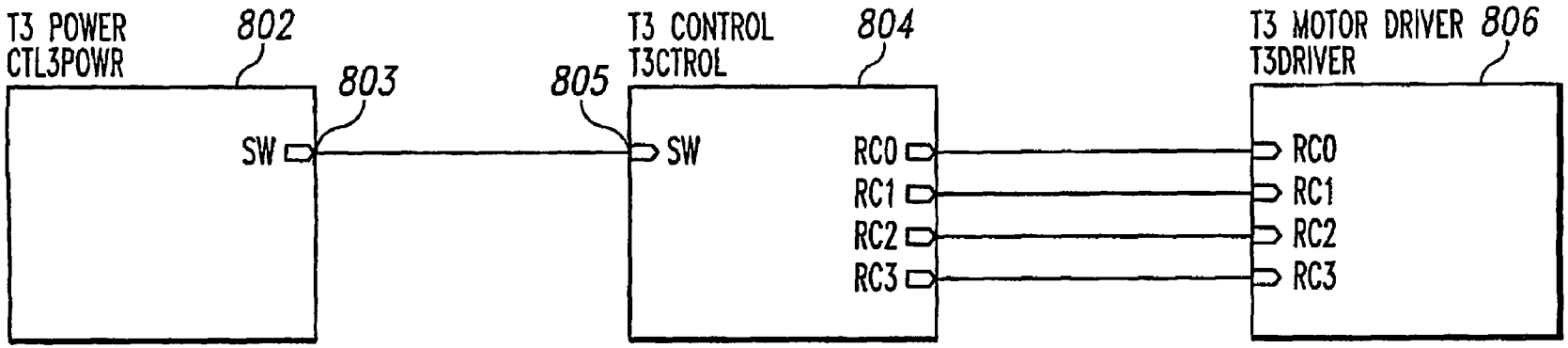
FIG. 39 is a block diagram of an alternative radio controlled throttle unit having a power supply circuit a controller circuit and a motor driver circuit.

As shown for example in FIGS. 32 and 37, clutch body 336 is coupled through rotor 314 to the shaft of motor 356. Illustratively, motor 356 is controlled to rotate counter clockwise, when viewed from the shaft end when the polarity is as is shown in FIG. 33*b*. In the illustrated embodiment, when the clutch body 336 rotates counter-clockwise, the throttle cable inner core, which is attached to clutch body 336, is pulled to advance the throttle of engine 12. When the polarity of motor 356 is the opposite of that shown in FIG. 33*b*, motor 356 rotates clockwise and throttle inner cable is urged forward to retard the throttle of engine 12.

A set screw 316 extends through clutch body 336 to secure clutch body 336 to rotor 314. A cable block and idle stop or cable bracket 312 is mounted to cover 324 adjacent clutch body 336 to limit throttle cable 319 adjustment. A cable core retention screw 311 is provided to secure cable 319 to clutch body 336.

When attaching the engine controller 300 to an engine 12, the throttle cable inner core end that features the brass barrel is attached to engine 12 in the usual manner. Working on the opposite end of the cable, the inner core of the cable 319 is passed through the cable bracket located on the top cover 324 of engine controller 300. The cable jacket is pushed into the cable socket on the cable bracket 312. Jacket fits snuggly into the socket. Clutch body 336 is rotated in a clockwise (Idle) direction until it is against its idle stop 312. Cable core retention screw 311 on the side of the clutch 336 is loosened until the cable core can be slipped underneath it and into the groove 313 on the clutch body 336. The end of the cable core is pulled to take up slack and seat the core into the groove 313 on the clutch body 336, and then core retention screw 311 is tightened.

To attach the engine controller 300 to the small Robin engine the red (+) lead of the electrical cable 320 of engine controller 300 is connected to the engine block. The black (−) lead of the electrical cable 320 of engine controller 300 is connected to the magneto stop lead.

To attach the engine controller 300 to the large Robin EHO 35 4-Cycle engine, the red (+) lead of the electrical cable 320 of engine controller 300 is attached to the female magneto lead. The black (−) lead of the electrical cable 320 of engine controller 300 is attached to the male magneto lead.

To attach the engine controller 300 to the small Honda GX-22 4-Cycle engine the red (+) lead of the electrical cable 320 of engine controller 300 is attached to the magneto stop lead. The black (−) lead of the electrical cable 320 of engine controller 300 is attached to the engine block.

To attaching the engine controller 300 to the large Honda GX-31 4-Cycle engine, the red (+) lead of the electrical cable 320 of engine controller 300 is attached to the magneto stop lead. The black (−) lead of the electrical cable 320 of engine controller 300 is attached to the engine block.

Figure 35:
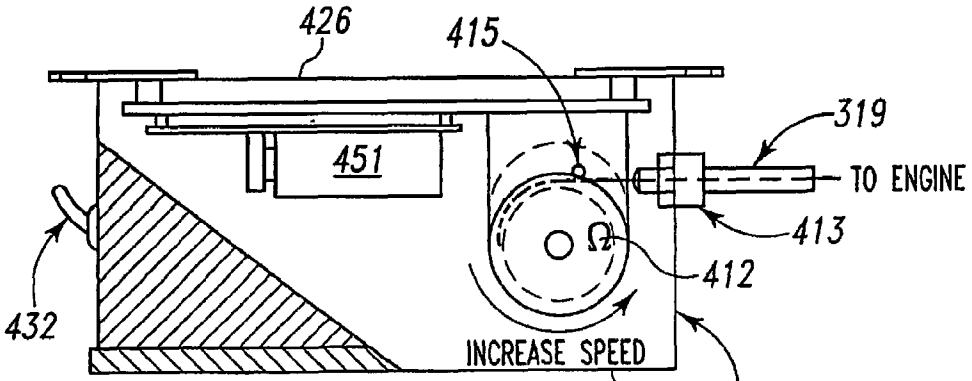
FIG. 35 is a side elevation view with portions removed of the alternative battery powered radio controlled throttle unit of FIG. 34.
Figure 36:
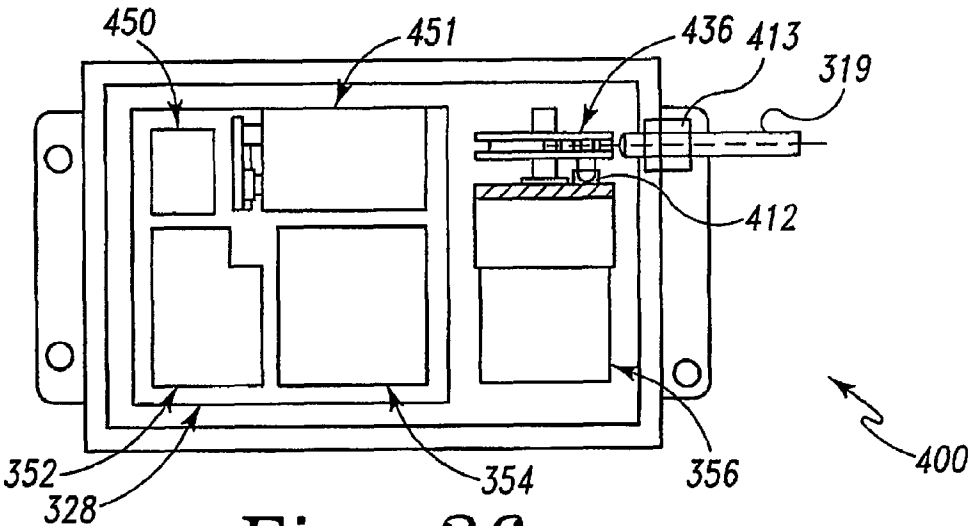
FIG. 36 is a top plan view with the housing top removed of the battery powered radio control throttle unit of FIG. 35.
Figure 34:
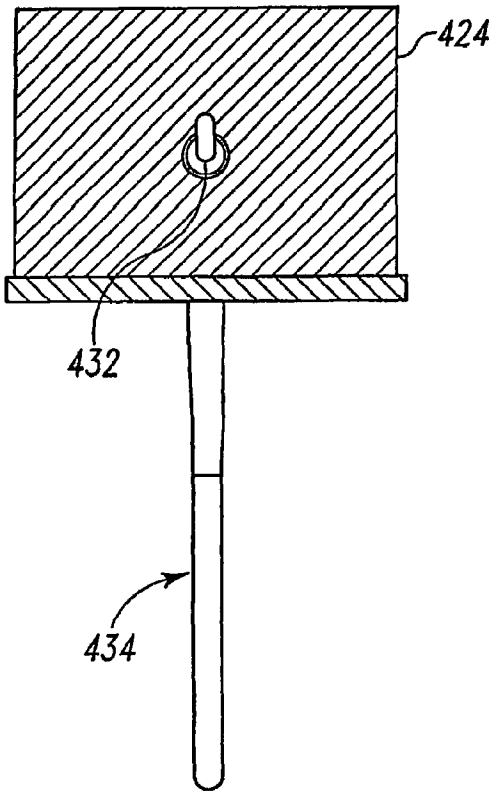
FIG. 34 is an end elevation view of an alternative radio controlled throttle unit.

As shown in FIGS. 34–36, an alternative engine controller 400 includes a switch 432 mounted on the side of cover 424 and an antenna 434 extending through the front surface of case 424. Engine controller 400 is similar to engine controller 300 and identical reference numerals are used for identical parts. Engine controller 400 differs from engine controller 300 in that battery 451 power is used in engine controller 400 so that power circuit 450 is more simplified. Also, shaft of motor 356 does not extend through cover 324 and a different clutch body 436 is utilized. As shown, in FIGS. 44 and 45, a grooved wheel 436 is coupled to shaft of motor 356, a cable guide 415 and an idle position stop 412 are coupled to the top of the motor 356 to maintain alignment of inner cable of throttle cable 319. A cable adapter socket 413 extends through side wall of cover 422 to receive cable 319. Operation of engine controller 400 is similar to engine controller 300 and will not be described in detail.

An alternative embodiment of a wireless remote throttle controller 801 includes a radio controlled throttle controller 800 and a remote control transmitter (not shown). Radio controlled throttle controller 800 is shown in block diagrams and schematically in FIGS. 39–42. Radio controlled throttle controller 800 draws most of its required electrical power from the magneto of engine 12. However, occasionally the magneto is incapable of providing all of the required electrical power. During these times some of the power is supplied by an onboard power supply, illustratively a 9-volt battery. Radio controlled throttle controller 800 includes designed to provide remote, wireless operation of the throttle of a Honda GX31 internal combustion engine 12. As shown, for example, in FIG. 39, radio controlled throttle controller 800 includes a power supply circuit 802, a control circuit 804 and a motor driver circuit 806. The output 803 of power supply circuit 802 is coupled to the input 805 of control circuit 804. The output of a control circuit 804 is coupled to the input of motor driver circuit 806.

Figure 40:
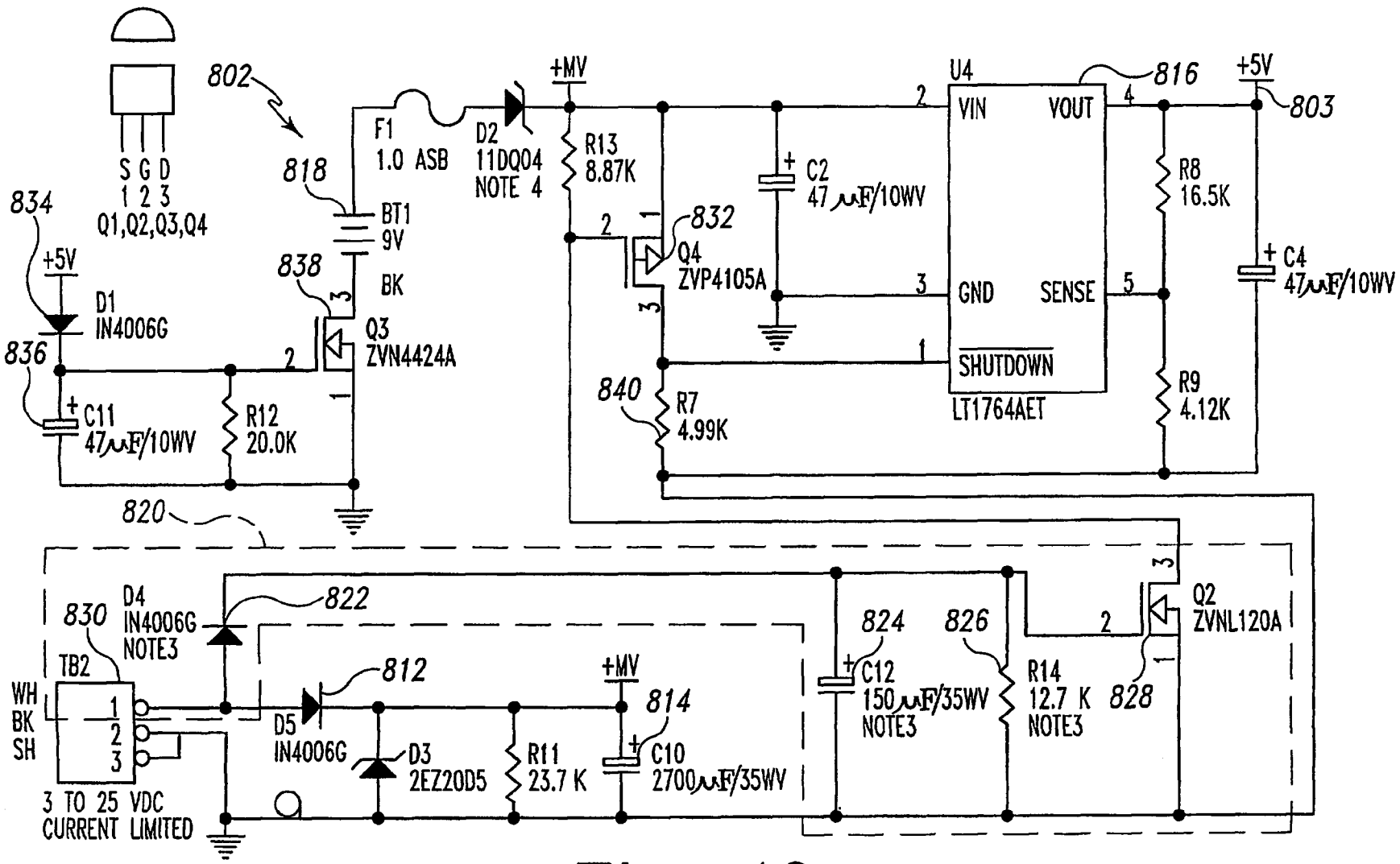
FIG. 40 is a schematic diagram of the power supply circuit of FIG. 39.
Figure 41:
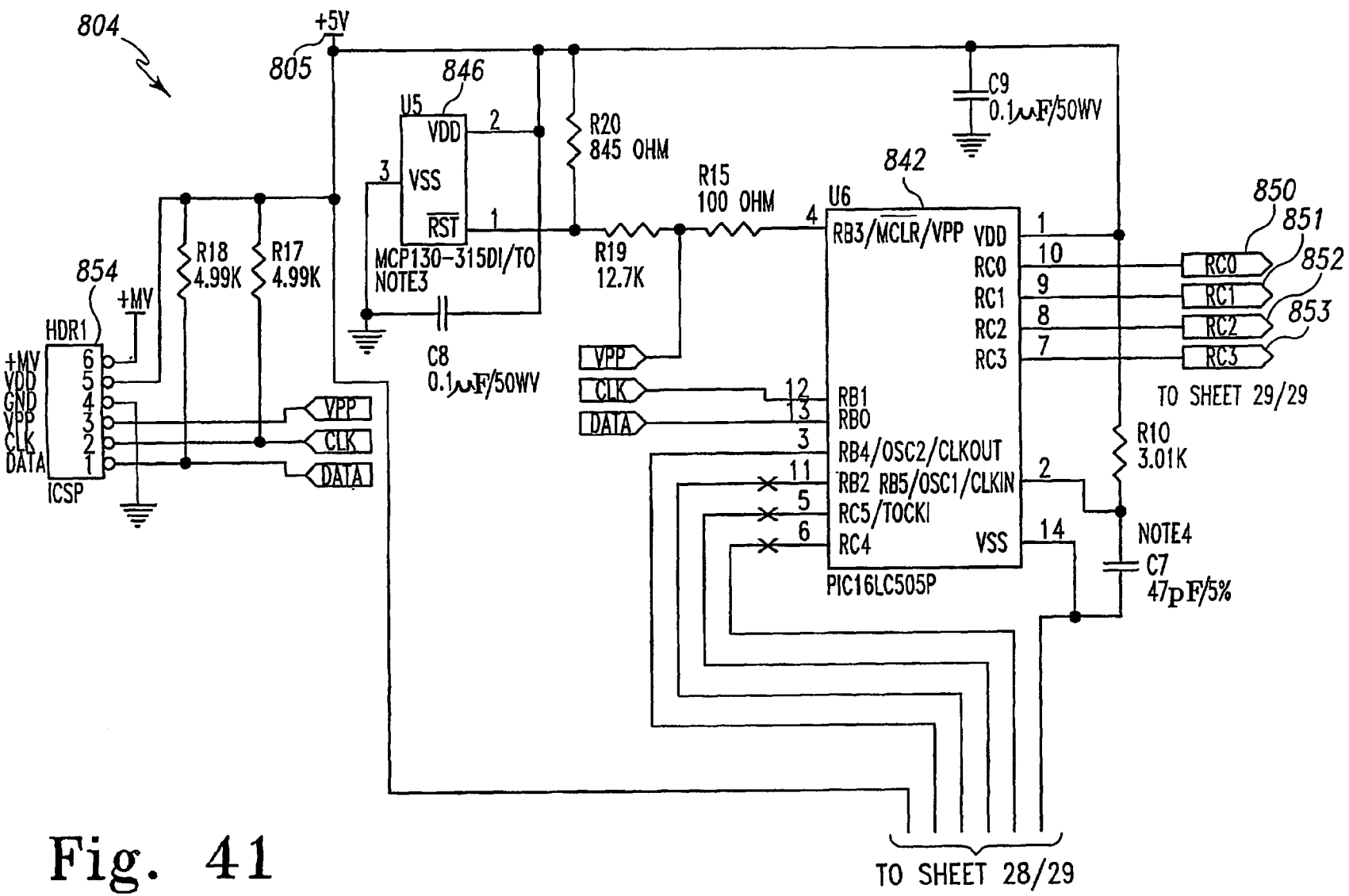
FIG. 41 is a schematic diagram of the controller circuit of FIG. 39; and, FIG. 42 is a schematic diagram of the motor driver circuit of FIG. 39.

Power supply circuit 802 is shown in greater detail in FIG. 40. Power supply circuit 802 is coupled through electrical connector 830 and electrical cable (similar to electrical cable 320) to magneto stop circuit of engine 12. The positive crest of the non-symmetrical alternating current obtained from the stop lead of the Honda GX31 engine magneto is rectified by diode (D5) 812 and filtered by capacitor (C10) 814. This filtered DC current is applied to voltage regulator (U4) 816. Voltage regulator 816 provides a regulated 5-volt DC current for use by the balance of the wireless throttle controller circuitry.

The amount of current available from the engine magneto is enough to operate radio controlled throttle controller 800 under all conditions except for a short period of time at the very beginning of engine throttle-up from idle when a gear motor incorporated in this device draws more current than the magneto can source. A 9-volt battery 818 is provided to supplement the current available from the magneto during the short time period when the magneto is unable to provide sufficient current to radio controlled throttle controller 800 controller. Because the magneto provides substantially all of the current required for the operation of radio controlled throttle controller 800, it is expected that the 9-volt battery 818 will have a very long service life.

Power supply circuit 802 has a unique shut down circuit in that it has, and uses, two sources of input power, i.e. from the magneto and from battery 818. Based on the presence or absence of one of the two power sources (i.e. the primary source from magneto), shut down circuit affects a powered up or shut down condition while simultaneously connecting or disconnecting the secondary power source or battery 818. The presence or absence of primary power applied to pin number 1 of connector (TB2) 830 by the magneto of an internal combustion engine 12 is detected by this circuit. The secondary power supplied by battery 818 is switched on and off based on the presence or absence of magneto power on pin 1 of connector 830.

The power supplied to voltage regulator 816 by battery 818 supplements the power supplied to voltage regulator 816 by the magneto. Battery power supplementation is desirable because, under certain conditions, the power supplied by the magneto is insufficient to power the circuitry that is down stream from the regulator 816.

A circuit 820 comprised of diode (D4) 822, capacitor (C12) 824, resistor (R14) 826 and MOSFET (Q2) 828 detect the presence of magneto power at pin 1 of connector 830. Diode 822 rectifies the non-symmetrical AC power from the magneto, changing it into Direct Current. Capacitor 824 filters the AC ripple out of this DC and along with resistor 826 provides an RC time constant that delays, for a short time, the shut off of the regulator circuit after the loss of magneto power. The filtered DC is applied to the gate, pin 2 of MOSFET 828. This applied DC causes MOSFET 828 to conduct current from its drain, pin 3 to its source, pin 1.

This conducted current causes MOSFET (Q4) 832 to conduct and pull pin 1 of voltage regulator 816 to +MV. This causes voltage regulator 816 to turn on and supply a regulated +5 volts on Vout pin 4 to the down stream circuitry. The regulated +5 volts is applied through blocking diode (D1) 834 to capacitor (C11) 836 and also to the gate, pin 2, of MOSFET (Q3) 838. This causes MOSFET 838 to conduct battery current from its drain, pin 3, to its source, pin 1. This action effectively connects the battery 818 to the circuit. At this point voltage regulator 816 has both magneto current and battery current applied to its input Vin at pin 2.

Upon loss of magneto current, and after a time delay provided by the circuit formed by capacitor (C12) 824 in parallel with resistor (R14) 826, the DC is removed from the gate of MOSFET (Q2) 828 and thus it stops conducting. This action causes MOSFET (Q4) 832 to stop conducting. When MOSFET 832 stops conducting, resistor (R7) 840 pulls shutdown, pin 1, of voltage regulator 816 to 0 volts. This causes voltage regulator 816 to shut off. The output voltage of the voltage regulator 816 then decays from +5 volts towards 0 volts. When this voltage approaches 0 volts, MOSFET (Q3) 838 stops conducting effectively disconnecting battery 818 from power supply circuit 802.

The 5-volt regulated output 803 of power supply circuit 802 is provided as an input 805 to control circuit 804. Control circuit or throttle control circuitry 804 is shown schematically in FIG. 41. Central to the operation of the throttle controller circuitry 804 is microcontroller (U6) 842.

Microcontroller 842 responds to input from the 418 MHz radio frequency receiver module (U1) 844. The human operator of the engine controller 801 issues commands to the controller via a small, 3-button, hand held remote control transmitter. These commands are received and decoded by the RF receiver 844.

Upon power up of the throttle controller 804, a voltage supervisor (U5) 846 holds the microcontroller 842 in a power up reset condition until the power supply voltage input 805 is proper and has stabilized.

Once the microcontroller 842 begins operating from power up reset, it biases MOSFET transistor (Q2) 848 off to hold RF receiver module (U1) 844 in a power off condition for approximately 1 second. This ensures a power on reset of the RF receiver module 844.

In response to input from the RF receiver module 844, the microcontroller 842 provides control signals on lines RC0 850, RC1 851, RC2 852 and RC3 853 to motor driver circuit 806 to cause the operation of a gear motor 860 that opens and closes the throttle of an internal combustion engine 12.

In response to input from the RF receiver module 844, microcontroller 842 will perform one of three operations, depending on the command issued by the human operator of the engine controller 801. It can increase the engine speed in an infinitely variable fashion. It can decrease the engine speed in an infinitely variable fashion. It can cause the engine speed to go all the way down to idle.

In between gear motor run operations, microcontroller 842 signals motor driver circuit 806 to provide a short circuit to gear motor 860. Because gear motor 860 has a permanent magnet field, motor 860 acts as a generator when it is coasting. The short circuit provides a heavy electrical load to this "generator". This effectively provides a braking action to gear motor 860 so that it will stop rather abruptly rather than coast to a stop. This method of braking motor 860 is commonly called dynamic braking.

It is within the scope of the disclosure to provide a spring centered, 2-position switch to address the needs of those users who want to be able to operate the engine throttle locally without the use of the remote control transmitter perhaps because, for one reason or another, the transmitter is not readily available.

Connector (HDR1) 854 can be used during production of the circuit board for In Circuit Serial Programming (ICSP) of microcontroller 842. Additionally, this connector 854 serves as a means of connecting a toggle switch to the circuit board. Microcontroller 842 can be programmed to respond appropriately to the actuation of this toggle switch.

A Single Pole-Double Throw, Spring Centered toggle switch can be connected to connector 854. The common terminal of this switch connects to pin 4 of connector 854—the GND pin. The pole of the switch that causes the engine speed to increase connects to pin 1 of connector 854—the DATA pin. The pole of the switch that causes the engine speed to decrease connects pin 2 of connector 854—the CLK pin. When the engine 12 is running, firmware programmed into microcontroller 842 causes the engine throttle to open or close, as required, in response to the actuation of the toggle switch.

Figure 42:
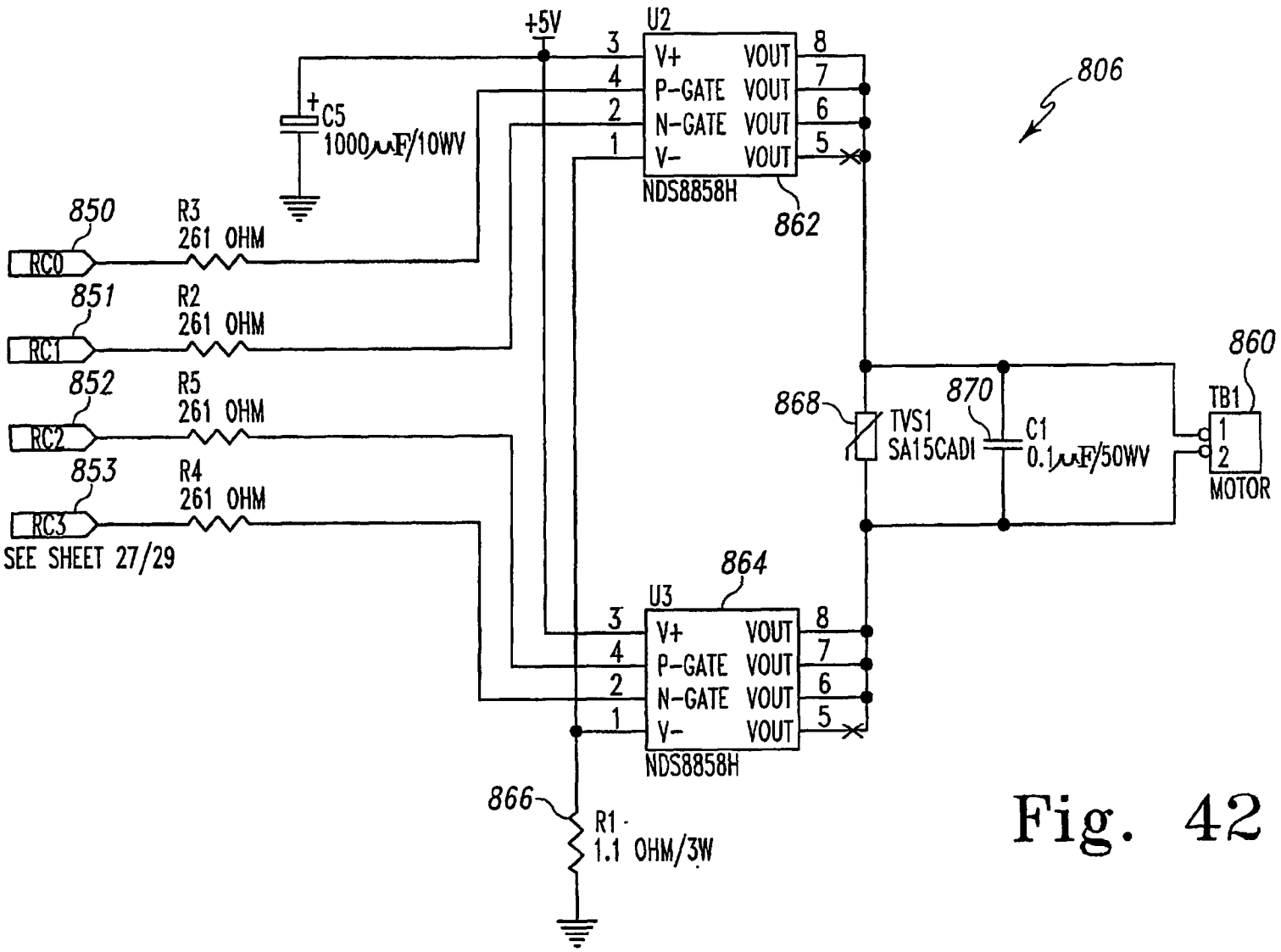

Motor driver circuit 806 is shown schematically in FIG. 42. Motor driver circuit 806 features 2 half bridge driver IC's (U2) 862 and (U3) 864. These two ICs 862, 864 are wired into what is commonly known as an H-Bridge driver circuit.

The H-Bridge driver circuit responds to signals from microcontroller 816 and applies current of a proper polarity to the gear motor 860. The direction of the rotation of the gear motor 860 is dependent on the polarity of the applied current.

Resistor (R1) 866 limits the current available to the gear motor 860. Bi-directional transient voltage suppressor (TVS1) 868 and capacitor (C1) 870 provide voltage spike and noise suppression respectively.

Each of the illustrated embodiments of vibratory power units 10, 210 is well adapted for use with concrete extruders which rapidly lay concrete for sidewalks and road ways. Such extruded sidewalks and road ways require floating and finishing of the surface, formation of construction joints, constituted joints and finishing of the edges. Since extruded sidewalks and roadways are typically formed from thicker and somewhat drier concrete, workers using standard hand and walk behind finishing tools are hard pressed to keep up with the finishing operations. Vibratory finishing tools such as those coupled to vibratory power units 10 and 210 allow a smaller number of finishers to keep up with the finishing operations required on extruded sidewalks and road ways.

As shown in FIG. 4 a jointing attachment 198 is provided for coupling to finishing tools 11 coupled to vibratory power unit 10. Jointing attachments 198 is configured to provide the proper depth construction joint in concrete. Because concrete in roadways is thicker than concrete in sidewalks and most other slabs, the construction joints and construction joints in roadways must be deeper than those in sidewalks and most other pads. Thus, a jointing attachment for use on road ways with elongated finishing tool 211 would be configured to extend substantially farther downwardly from the finishing face of elongated finishing tool 211 coupled to vibratory power unit 210 than the jointing attachment 198 which is to be used with a finishing tool 11 coupled to vibratory power unit 10. Jointing attachment 198 is configured to be removably attached to finishing tools 11 as jointing attachments typically wear out faster than the finishing tool to which they are attached.

It is within the scope of the disclosure to couple a flexible extension, such as a 312 RH shaft assembly available from Elliott Manufacturing, Binghampton, N.Y. as part no. A00218 to vibratory power unit 10. The distal end of the flexible casing of the described flexible extension is provided with couplings having an externally threaded fitting. The internal threads in aperture 87 of vibrator cases 14, 614 are of the size and pattern to mate with these external threads. A cable core acting as an adapter available from Elliott Manufacturing, Binghampton, N.Y. as part no. A00221 may be used to couple the flexible shaft or cable of the flexible extension to the flexible shaft or cable 15 of vibratory power unit 10. Those skilled in the art will recognize that when the flexible extension is used, isolation unit 18 and second rigid shaft case portion 20 can be removed from vibratory power unit 10 as the flexible case of the flexible extension will act to isolate the vibrator 13 from the power unit 10.

While specific embodiments of vibratory power units have been described, those skilled in the art will recognize that other arrangements of components and steps are within the teaching of the disclosure.

What is claimed is:

1. A concrete finishing tool comprising:

an internal combustion engine having a rotating shaft and a housing;

a vibrator including a vibrator case and an eccentric housed for rotation therein, said eccentric being coupled to the rotating shaft of the internal combustion engine by a drive shaft;

a semi-rigid mechanical coupling extending between the housing of the internal combustion engine and the vibrator case, said coupling including a semi-rigid shaft case and an isolation unit through which the drive shaft passes, the isolation unit being disposed between the internal combustion engine and the vibrator to reduce vibrations experienced by the internal combustion engine and the isolation unit includes a first rigid portion, a second-rigid portion and an anti-vibration portion therebetween;

a coupling configured to releasably couple the vibrator to a concrete finishing tool, the coupling being configured to transfer vibration from the vibrator to the finishing tool.

2. The device of claim 1 and further comprising a handle coupled to the semi-rigid shaft case whereby the user can control rotation of a concrete finishing tool coupled to the vibrator.

3. The device of claim 1 wherein the coupling is configured to permit adjustment of the vertical angle between the finishing face of the concrete finishing tool and the longitudinal axis of the semi-rigid shaft case.

4. The device of claim 1 wherein the coupling is configured to permit adjustment of the horizontal angle between the concrete finishing tool and the longitudinal axis of the semi-rigid shaft case.

5. The device of claim 1 wherein the first and second rigid portions are respectfully a first rigid shaft case portion and a second rigid shaft case portion and the isolation portion couples the first rigid shaft case portion of the semi-rigid shaft case to the second rigid shaft case portion.

6. The device of claim 1 wherein the first and second rigid portions the isolation unit include proximal, central and distal plates and the anti-vibration portion includes proximal and distal anti-vibration portions, the proximal anti-vibration portion being disposed between the proximal and central plate and the distal anti-vibration portion being disposed between the distal and central plates.

7. The device of claim 6 wherein the semi-rigid shaft case includes a first rigid shaft case portion and a second rigid shaft case portion and the isolation unit couples the first rigid shaft case portion to the second rigid shaft case portion.

8. The device of claim 7 wherein the first rigid shaft case portion is rigidly coupled to the central plate and the second rigid shaft case portion is rigidly coupled to the distal plate.

9. The device of claim 1 wherein the vibrator utilizes sealed bearings to permit rotation of the eccentric within the vibrator case.

10. The device of claim 1 wherein the vibrator is chosen from a plurality of vibrators of varying lengths and diameters, each of the plurality of vibrators being configured for attachment to the semi-rigid shaft case.

11. The device of claim 1 and further comprising a mount for mounting the internal combustion engine to the concrete finishing tool and an elongated handle for manipulating the concrete finishing tool and internal combustion engine as a unit.

12. The device of claim 11 and further comprising an attachment for coupling the handle to the finishing tool, said attachment permitting selective alteration of the vertical angle between the concrete finishing tool and the longitudinal axis of the handle.

13. The device of claim 11 wherein the mount is configured to couple the vibrator to the concrete finishing tool.

14. The device of claim 12 wherein the mount is configured to transfer vibrations from the vibrator to the concrete finishing tool.

15. The device of claim 11 wherein the mount is figured to permit coupling of the attachment and the vibrator at substantially the same position between the ends of the concrete finishing tool.

16. The device of claim 14 wherein the mount provides structural support to the concrete finishing tool.

17. The device of claim 11 and further comprising a remotely actuatable throttle control.

18. The device of claim 17 wherein the remotely actuatable throttle control is configured to control actuators powered by power scavenged from the engine's magneto circuitry.

* * * * *